United States Patent [19]

Watanabe

[11] Patent Number: 4,720,729

[45] Date of Patent: Jan. 19, 1988

[54] IMAGE FORMING APPARATUS WITH EDITING FUNCTION

[75] Inventor: Junji Watanabe, Yokohama, Japan

[73] Assignee: Kabushiki Kaisha Toshiba, Kawasaki, Japan

[21] Appl. No.: 809,416

[22] Filed: Dec. 13, 1985

[30] Foreign Application Priority Data

| | | | |
|---|---|---|---|
| Dec. 17, 1984 | [JP] | Japan | 59-265780 |
| Jan. 23, 1985 | [JP] | Japan | 60-10472 |
| Feb. 20, 1985 | [JP] | Japan | 60-33108 |

[51] Int. Cl.[4] ..... G03G 15/00

[52] U.S. Cl. ..... 355/14 R; 355/4; 355/7; 355/14 E; 355/55

[58] Field of Search ..... 355/4, 7–8, 355/14 R, 14 E, 55–57

[56] References Cited

U.S. PATENT DOCUMENTS

| | | | |
|---|---|---|---|
| 4,045,218 | 8/1977 | McVeigh | 355/4 X |
| 4,354,757 | 10/1982 | Ritzerfield | 355/7 |
| 4,417,805 | 11/1983 | Kishi | 355/7 X |
| 4,627,707 | 12/1986 | Tani et al. | 355/7 |
| 4,634,260 | 1/1987 | Watanabe | 355/14 E X |

*Primary Examiner*—A. T. Grimley
*Assistant Examiner*—Jane K. Lau
*Attorney, Agent, or Firm*—Schwartz, Jeffery, Schwaab, Mack, Blumenthal & Evans

[57] ABSTRACT

An image forming apparatus with an original table, an original scanning section for optically scanning an origical placed on the original table, an image forming section for processing image information from the original scanning section and forming an image on an image forming medium, and an image forming medium feedback section for feeding back the image forming medium again to the image forming section, has shift source and destination specifying sections for moving light transmitted through desired first and second portions of the original placed on the original table and specifying shift source and destination, a first control section for calculating position information of the first and second portions and distance information representing a distance between the first and second portions and storing the position information and the distance information, an erasing section for erasing desired image formation information of the image forming section in accordance with specified information, a second control section for reading out the position information of the first portion from the first control section and supplying it to the erasing section and generating a signal for driving the image formation medium feedback section, and a third control section for reading out the distance information and the position information representing a portion excluding the second portion from the first control section and supplying readout information to a magnification control section of the original scanning section and the erasing section.

18 Claims, 69 Drawing Figures

FIG. 3

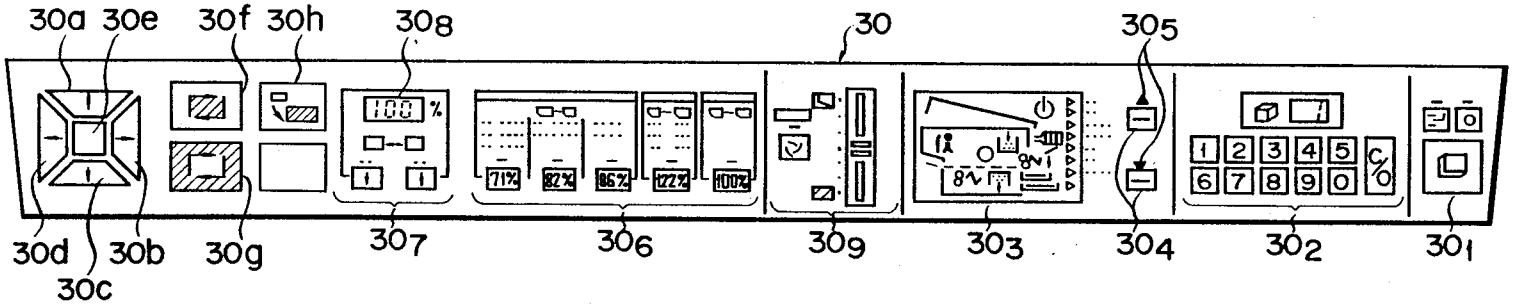
30
30a
30b
30c
30d
30e
30f
30g
30h
30i
30j
30k
30l
30m
30n
30o
30p
30q
30r
30s
30t
30u
30v
30w
30x
30y
30z
30aa
30ab
30ac
30ad
30ae
30af
30ag
30ah
30ai
30aj
30ak
30al
30am
30an
30ao
30ap
30aq
30ar
30as
30at
30au
30av
30aw
30ax
30ay
30az
30ba
30bb
30bc
30bd
30be
30bf
30bg
30bh
30bi
30bj
30bk
30bl
30bm
30bn
30bo
30bp
30bq
30br
30bs
30bt
30bu
30bv
30bw
30bx
30by
30bz
30ca
30cb
30cc
30cd
30ce
30cf
30cg
30ch
30ci
30cj
30ck
30cl
30cm
30cn
30co
30cp
30cq
30cr
30cs
30ct
30cu
30cv
30cw
30cx
30cy
30cz
30da
30db
30dc
30dd
30de
30df
30dg
30dh
30di
30dj
30dk
30dl
30dm
30dn
30do
30dp
30dq
30dr
30ds
30dt
30du
30dv
30dw
30dx
30dy
30dz
30ea
30eb
30ec
30ed
30ee
30ef
30eg
30eh
30ei
30ej
30ek
30el
30em
30en
30eo
30ep
30eq
30er
30es
30et
30eu
30ev
30ew
30ex
30ey
30ez
30fa
30fb
30fc
30fd
30fe
30ff
30fg
30fh
30fi
30fj
30fk
30fl
30fm
30fn
30fo
30fp
30fq
30fr
30fs
30ft
30fu
30fv
30fw
30fx
30fy
30fz
30ga
30gb
30gc
30gd
30ge
30gf
30gg
30gh
30gi
30gj
30gk
30gl
30gm
30gn
30go
30gp
30gq
30gr
30gs
30gt
30gu
30gv
30gw
30gx
30gy
30gz
30ha
30hb
30hc
30hd
30he
30hf
30hg
30hh
30hi
30hj
30hk
30hl
30hm
30hn
30ho
30hp
30hq
30hr
30hs
30ht
30hu
30hv
30hw
30hx
30hy
30hz
30ia
30ib
30ic
30id
30ie
30if
30ig
30ih
30ii
30ij
30ik
30il
30im
30in
30io
30ip
30iq
30ir
30is
30it
30iu
30iv
30iw
30ix
30iy
30iz
30ja
30jb
30jc
30jd
30je
30jf
30jg
30jh
30ji
30jj
30jk
30jl
30jm
30jn
30jo
30jp
30jq
30jr
30js
30jt
30ju
30jv
30jw
30jx
30jy
30jz
30ka
30kb
30kc
30kd
30ke
30kf
30kg
30kh
30ki
30kj
30kk
30kl
30km
30kn
30ko
30kp
30kq
30kr
30ks
30kt
30ku
30kv
30kw
30kx
30ky
30kz
30la
30lb
30lc
30ld
30le
30lf
30lg
30lh
30li
30lj
30lk
30ll
30lm
30ln
30lo
30lp
30lq
30lr
30ls
30lt
30lu
30lv
30lw
30lx
30ly
30lz
30ma
30mb
30mc
30md
30me
30mf
30mg
30mh
30mi
30mj
30mk
30ml
30mm
30mn
30mo
30mp
30mq
30mr
30ms
30mt
30mu
30mv
30mw
30mx
30my
30mz
30na
30nb
30nc
30nd
30ne
30nf
30ng
30nh
30ni
30nj
30nk
30nl
30nm
30nn
30no
30np
30nq
30nr
30ns
30nt
30nu
30nv
30nw
30nx
30ny
30nz
30oa
30ob
30oc
30od
30oe
30of
30og
30oh
30oi
30oj
30ok
30ol
30om
30on
30oo
30op
30oq
30or
30os
30ot
30ou
30ov
30ow
30ox
30oy
30oz
30pa
30pb
30pc
30pd
30pe
30pf
30pg
30ph
30pi
30pj
30pk
30pl
30pm
30pn
30po
30pp
30pq
30pr
30ps
30pt
30pu
30pv
30pw
30px
30py
30pz
30qa
30qb
30qc
30qd
30qe
30qf
30qg
30qh
30qi
30qj
30qk
30ql
30qm
30qn
30qo
30qp
30qq
30qr
30qs
30qt
30qu
30qv
30qw
30qx
30qy
30qz
30ra
30rb
30rc
30rd
30re
30rf
30rg
30rh
30ri
30rj
30rk
30rl
30rm
30rn
30ro
30rp
30rq
30rr
30rs
30rt
30ru
30rv
30rw
30rx
30ry
30rz
30sa
30sb
30sc
30sd
30se
30sf
30sg
30sh
30si
30sj
30sk
30sl
30sm
30sn
30so
30sp
30sq
30sr
30ss
30st
30su
30sv
30sw
30sx
30sy
30sz
30ta
30tb
30tc
30td
30te
30tf
30tg
30th
30ti
30tj
30tk
30tl
30tm
30tn
30to
30tp
30tq
30tr
30ts
30tt
30tu
30tv
30tw
30tx
30ty
30tz
30ua
30ub
30uc
30ud
30ue
30uf
30ug
30uh
30ui
30uj
30uk
30ul
30um
30un
30uo
30up
30uq
30ur
30us
30ut
30uv
30uw
30ux
30uy
30uz
30va
30vb
30vc
30vd
30ve
30vf
30vg
30vh
30vi
30vj
30vk
30vl
30vm
30vn
30vo
30vp
30vq
30vr
30vs
30vt
30vu
30vv
30vw
30vx
30vy
30vz
30wa
30wb
30wc
30wd
30we
30wf
30wg
30wh
30wi
30wj
30wk
30wl
30wm
30wn
30wo
30wp
30wq
30wr
30ws
30wt
30wu
30wv
30ww
30wx
30wy
30wz
30xa
30xb
30xc
30xd
30xe
30xf
30xg
30xh
30xi
30xj
30xk
30xl
30xm
30xn
30xo
30xp
30xq
30xr
30xs
30xt
30xu
30xv
30xw
30xx
30xy
30xz
30ya
30yb
30yc
30yd
30ye
30yf
30yg
30yh
30yi
30yj
30yk
30yl
30ym
30yn
30yo
30yp
30yq
30yr
30ys
30yt
30yu
30yv
30yw
30yx
30yy
30yz
30za
30zb
30zc
30zd
30ze
30zf
30zg
30zh
30zi
30zj
30zk
30zl
30zm
30zn
30zo
30zp
30zq
30zr
30zs
30zt
30zu
30zv
30zw
30zx
30zy
30zz 30a
30e
30f
30h
30i
30k
30A
30d
30c
30b
30g
30j
30l
RED
BLACK
30l
30m
30n
30o
30p
30q
30r
30s
30t
30u
30v
30w
30x
30y
30z
30A
30B
30C
30D
30E
30F
30G
30H
30I
30J
30K
30L
30M
30N
30O
30P
30Q
30R
30S
30T
30U
30V
30W
30X
30Y
30Z
30a
30b
30c
30d
30e
30f
30g
30h
30i
30j
30k
30l
30m
30n
30o
30p
30q
30r
30s
30t
30u
30v
30w
30x
30y
30z
30A
30B
30C
30D
30E
30F
30G
30H
30I
30J
30K
30L
30M
30N
30O
30P
30Q
30R
30S
30T
30U
30V
30W
30X
30Y
30

IMAGE FORMING APPARATUS WITH EDITING FUNCTION

BACKGROUND OF THE INVENTION

This invention relates to an image forming apparatus with an editing function and, more particularly, to an image forming apparatus suitable for an electronic copying machine and having an editing function for shifting an image portion specified by a first area to a second area and forming the resulting image.

Conventional electronic copying machines have functions for copying original images in equal, enlarged and reduced sizes.

Original images often contain unnecessary portions or portions to be reduced or enlarged. However, no conventional copying machine has editing functions for partially erasing an original image and copying the partially erased image, or for enlarging, reducing or shifting an image portion and copying the resulting image. In addition, no conventional copying machine can properly edit a plurality of original images or copy a single edited image.

SUMMARY OF THE INVENTION

It is, therefore, an object of the present invention to provide a new and improved image forming apparatus with an editing function which can selectively erase, enlarge, reduce or shift any portion of an original image and form an edited image.

It is another object of the present invention to provide an image forming apparatus with an editing function which can selectively erase, enlarge, reduce or shift any portion of an original image and form an edited image in a color different from the remaining portion.

It is still another object of the present invention to provide an image forming apparatus with an editing function which can selectively erase, enlarge, reduce or shift any portion of an original image, form an edited image, and at the same time edit a plurality of original images and copy the edited image.

For example, the present invention uses an original multicopying function, a function for specifying any area of the original, a function for erasing an image in the specified area, and functions for enlarging or reducing the original image and shifting the center of the copied image. Therefore, an image specified by the first area is enlarged or reduced, and a copied image is then formed in a second area.

For example, the present invention also uses an original multicopying function, a function for specifying any area of the original, a function for erasing an image within or outside the specified area, an image enlargement function, an image reduction function, and an image shift function. Therefore, an image of a desired portion of the original can be shifted to another portion of the original, and the resulting edited image can be copied in a color different from the remaining portion.

For example, the present invention uses an original multicopying function, a function for specifying any area of the original, a function for erasing an image within or outside the specified area, an image enlargment function, an image reduction function, and an image shift function. Therefore, an image of a desired portion of an original can be shifted to a desired portion of another original.

These and other objects and features of the present invention can be understood through the following embodiments by reference to the accompanying drawings.

According to one aspect of the present invention, there is provided an image forming apparatus with an editing function, the apparatus comprising:

an original table on which an original is placed, the original being capable of transmitting light therethrough;

light-transmitting means for emitting light to the original placed on the original table while the light is moved therealong;

shift source specifying means for moving the light from the light-transmitting means along a desired first portion of the original placed on the original table and specifying a shift source;

shift destination specifying means for moving the light from the light-transmitting means along a desired second portion of the original placed on the original table and specifying a shift destination;

first controlling means for calculating position information of the desired first portion specified by the shift source specifying means, position information of a portion excluding the desired second portion specified by the shift destination specifying means, and distance information representing a distance between the desired first and second portions in accordance with shift data of light moved by the light-transmitting means, and for storing the calculated information;

original scanning means arranged to be movable along the original table and having a first optical system for optically scanning the original placed on the original table and a second optical system movable to extract an image reflected by the first optical system from the original with a predetermined magnification;

image forming means for focusing the reflected image extracted by the original scanning means on an image forming medium, and developing and forming an image corresponding to the reflected image on the image forming medium;

image erasing means for selectively erasing an image formed by the image forming means;

image forming medium feedback means for selectively feeding back to the image forming means the image forming medium with the image formed by the image forming means;

second controlling means for reading out the position information of the desired first portion of the original from the first controlling means during formation of a first image, supplying the readout position information to the image erasing means, and at the same time generating a feedback operation command signal to be supplied to the image forming medium feedback means; and third controlling means for reading out the distance information representing the distance between the desired first and second portions of the original and the position information representing the portion excluding the desired second portion of the original from the first controlling means and for supplying the readout distance information and position information to the second optical system of the original scanning means and the image erasing means.

BRIEF DESCRIPTION OF THE DRAWINGS

FIGS. 1 to 28A–28E show a first embodiment of an image forming apparatus according to the present invention, in which:

FIGS. 1 and 2 are a schematic perspective view and a side sectional view, respectively, showing the construction of the image forming apparatus;

FIG. 3 is a plan view of a control panel;

FIG. 4 is a perspective view showing an arrangement of drive sections;

FIG. 5 is a perspective view schematically showing a drive mechanism for an optical system;

FIG. 6 is a perspective view schematically showing a drive mechanism for indexes;

FIG. 7 is a perspective view schematically showing a variable magnification lens drive mechanism;

FIG. 9 is a block diagram showing a general control circuit;

FIG. 10 is a functional block diagram of a main processor group;

FIG. 11 is a functional block diagram of a first sub-processor group;

FIG. 12 is a functional block diagram of a second sub-processor group;

FIG. 13 is a block diagram of a pulse motor control circuit;

FIGS. 14A and 14B are charts for explaining a method of controlling pulse motor speed;

FIG. 15 is a perspective view of the principal part including a spot light source;

FIG. 16 is a side sectional view of the principal part including the spot light source;

FIGS. 17, 18 and 19 are plan views illustrating an operation for specifying the erasure range of the original using the spot light source;

FIGS. 20 and 21 are plan views for explaining memory contents;

FIGS. 23 and 24 are a perspective view and a front view, respectively, of only the principal part of the erasure array, showing the relationship between the erasure array and a photosensitive drum;

FIG. 26 is a circuit diagram illustrating the configuration of an array drive section;

FIG. 27 is a plan view showing the principal part for explaining editing and copying; and FIGS. 28A to 28E are plan views for explaining editing and copying;

FIGS. 29 to 40A–40E show a second embodiment of an image forming apparatus according to the present invention, in which:

FIGS. 29 and 30 are a schematic perspective view and a side sectional view, respectively, showing the construction of the image forming apparatus;

FIGS. 31 and 32 are side sectional views, respectively, for explaining multicopying and two-side copying;

FIG. 33 is a plan view of a control panel;

FIG. 34 is a perspective view showing an arrangement of drive sections;

FIG. 35 is a perspective view schematically showing a mechanism for driving a feed roller and a separation roller;

FIG. 37 is a block diagram showing a general control circuit;

FIG. 38 is a plan view for explaining editing and copying; and

FIGS. 39A to 39E and FIGS. 40A to 40E are plan views for explaining editing and copying operations; and FIGS. 41 to 47 show a third embodiment of an image forming apparatus according to the present invention, in which:

FIGS. 41 and 42 are a schematic perspective view and a side sectional view, respectively, showing the construction of the image forming apparatus;

FIG. 43 is a plan view of a control panel;

FIG. 44 is a plan view showing the principal part for explaining editing and copying;

FIGS. 46 and 47 are plan views showing the principal part for explaining different editing and copying operations.

DETAILED DESCRIPTION OF THE PREFERRED EMBODIMENTS

Preferred Embodiments of the present invention will be described with reference to the accompanying drawings.

Figure 1:
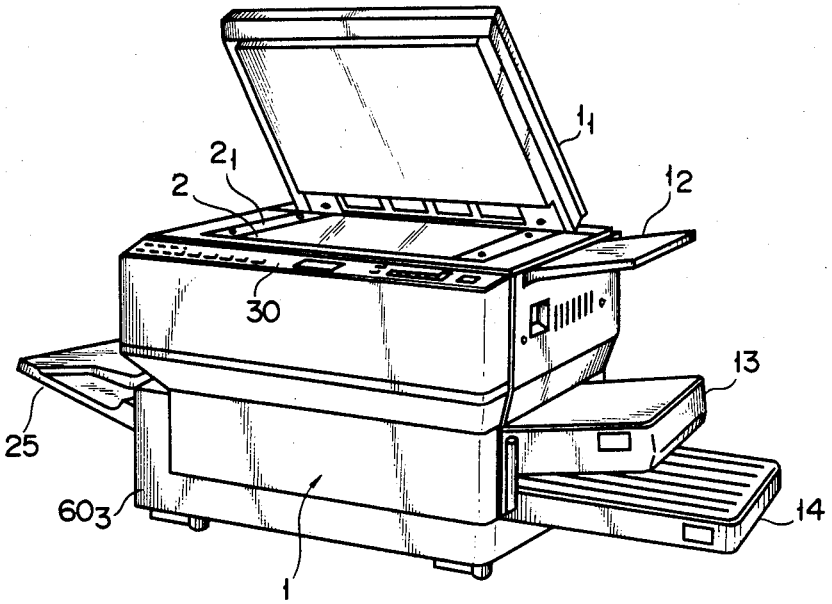
Figure 2:
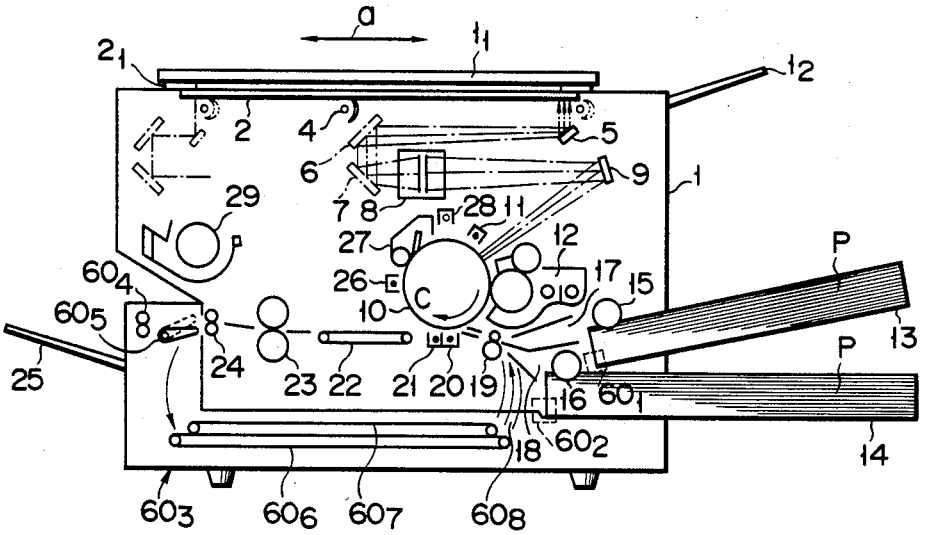

FIGS. 1 and 2 schematically show a copying machine as an image forming apparatus according to a first embodiment of the present invention. Reference numeral 1 denotes a copying machine housing. An original table (i.e., a transparent glass) 2 is fixed on the upper surface of the housing 1. An openable original cover $1_1$ and a work table $1_2$ are arranged near the table 2. A fixed scale $2_1$ as a reference for setting an original is arranged at one end of the table 2 along the longitudinal direction thereof.

The original set on the original table 2 is scanned for image exposure as an optical system 3 including an exposure lamp 4 and mirrors 5, 6 and 7 reciprocates in the direction indicated by arrow a along the under surface of the original table 2. In this case, the mirrors 6 and 7 move at a speed half that of the mirror 5 so as to maintain a fixed optical path length.

A reflected light beam from the original scanned by the optical system 3, that is, irradiated by the exposure lamp 4, is reflected by the mirrors 5, 6 and 7, transmitted through a lens block 8 for magnification or reduction, and then reflected by a mirror 9 to be projected on a photosensitive drum 10. Thus, an image of the original is formed on the surface of the photosensitive drum 10.

The photosensitive drum 10 rotates in the direction indicated by arrow c so that its surface is wholly charged first by a main charger 11. The image of the original is projected on the charged surface of the photosensitive drum 10 by slit exposure, forming an electrostatic latent image on the surface. The electrostatic latent image is developed into a visible image (toner image) by a developing unit 12 using toner. Paper sheets (image record media) P are delivered one by one from an upper paper cassette 13 or a lower paper cassette 14 by a paper-supply roller 15 or 16, and guided along a paper guide path 17 or 18 to an aligning roller pair 19. Then, each paper sheet P is delivered to a transfer region by the aligning roller pair 19, timed to the formation of the visible image.

The two paper cassettes 13 and 14 are removably attached to the lower right end portion of the housing 1, and can be alternatively selected by operation on a control panel which will be described in detail later. The paper cassettes 13 and 14 are provided respectively with cassette size detecting switches 601 and 602 which detect the selected cassette size. The detecting switches 601 and 602 are each formed of a plurality of microswitches which are turned on or off in response to insertion of cassettes of different sizes.

The paper sheet P delivered to the transfer region comes into intimate contact with the surface of the photosensitive drum 10, in the space between a transfer charger 20 and the drum 10. As a result, the toner image on the photosensitive drum 10 is transferred to the paper sheet P by the agency of the charger 20. After the transfer, the paper sheet P is separated from the photosensitive drum 10 by a separation charger 21 and transported by a conveyor belt 22. Thus, the paper sheet P is delivered to a fixing roller pair 23 as a fixing unit arranged at the terminal end portion of the conveyor belt 22. As the paper sheet P passes through the fixing roller pair 23, the transferred image is fixed on the sheet P. After the fixation, the paper sheet P is discharged into a tray 25 outside the housing 1 by two exit roller pairs 24, $60_4$.

After the transfer, moreover, the photosensitive drum 10 is de-electrified by a de-electrification charger 26, when the residual toner on the surface of the drum 10 is removed by a cleaner 27. Thereafter, a residual image on the photosensitive drum 10 is erased by a discharge lamp 28 to restore the initial state. In FIG. 2, numeral 29 designates a cooling fan for preventing the temperature inside the housing 1 from rising.

Referring to FIG. 2, multicopying unit $60_3$ is arranged at the bottom of housing 1 and is used in the editing and copying mode. Unit $60_3$ feeds back the copied sheet to aligning roller pair 19 so as to form another image on the same sheet surface after the copied sheet is fed by discharge roller pair 24. Selection gate $60_5$ is arranged in unit $60_3$ between discharge roller pairs 24 and $60_4$. During copying, gate $60_5$ is set in the position indicated by the solid line in FIG. 2. However, in the editing/copying mode, gate $60_5$ is set in the position indicated by the broken line. The sheet fed out by roller pair 24 is thus guided between conveyor belts $60_6$ and $60_7$. Belts $60_6$ and $60_7$ convey the sheet while clamping it therebetween so that the sheet is guided along guide path $60_8$. The sheet guided along path $60_8$ is then fed to photosensitive drum 10 in synchronism with the optical system.

FIG. 3 shows a control panel 30 mounted on the housing 1. The control panel 30 carries thereon a copy key $30_1$ for starting the copying operation, ten-keys $30_2$ for setting the number of copies to be made and the like, a display section $30_3$ for indicating the operating conditions of the individual parts or paper jamming, cassette selection keys $30_4$ for alternatively selecting the upper or lower paper cassette 13 or 14, and cassette display sections $30_5$ for indicating the selected cassette. The control panel 30 is further provided with ratio setting keys $30_6$ for setting the enlargement or reduction ratio of copy selected among several predetermined ratios, zoom keys $30_7$ for adjustably setting the enlargement or reduction ratio, a display section $30_8$ for displaying the set ratio, and a density setting section $30_9$ for setting the copy density. Additionally arranged on the control panel 30 are operation keys 30*a*, 30*b*, 30*c* and 30*d* for shifting a spot light source (mentioned later) which serves to indicate as erasure area an unnecessary portion of the original, a position designating key 30*e* for inputting the coordinate positions indicated by the spot light source, and erasure range designating keys 30*f* and 30*g* for designating the erasure ranges in the designated positions.

Reference numeral 30*h* denotes an editing specifying key for enlarging or reducing an image specified by a spot light source and forming an enlarged or reduced image in an image portion specified by the spot light source.

Figure 4:
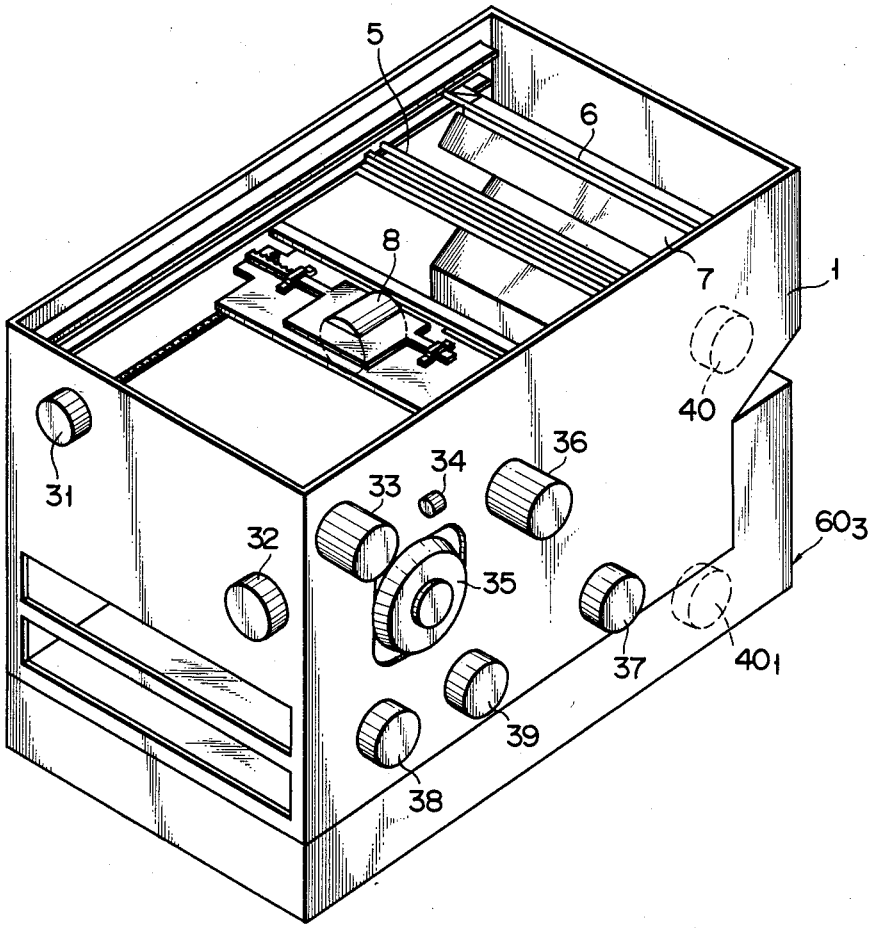

FIG. 4 shows a specific arrangement of drive sources for individual drive sections of the copying machine constructed in the aforesaid manner. The drive sources include the following motors. Numeral 31 designates a motor for lens drive. The lens drive motor 31 serves to shift the position of the lens block 8 for magnification or reduction. Numeral 32 designates a motor for mirror drive. The mirror drive motor 32 serves to change the distance (optical path length) between the mirror 5 and the mirrors 6 and 7 for magnification or reduction. Numeral 33 designates a stepping motor for scanning. The stepping motor 33 serves to move the exposure lamp 4 and the mirrors 5, 6 and 7 for scanning the original. Numeral 34 designates a motor for shutter drive. The shutter drive motor 34 serves to move a shutter (not shown) for adjusting the width of charging of the photosensitive drum 10 by the charger 11 at the time of magnification or reduction.

Numeral 35 designates a motor used for developing. The developing motor 35 serves to drive the developing roller and the like of the developing unit 12. Numeral 36 designates a motor used to drive the drum. The drum drive motor 36 serves to drive the photosensitive drum 10. Numeral 37 designates a motor for fixation. The fixing motor 37 serves to drive the sheet conveyor belt 22, the fixing roller pair 23, and the exit roller pair 24. Numeral 38 designates a motor for paper supply. The paper supply motor 38 serves to drive the paper supply rollers 15 and 16. Numeral 39 designates a motor for feeding sheets. The sheet feed motor 39 serves to drive the aligning roller pair 19. Numeral 40 designates a motor for fan drive. The fan motor 40 serves to drive the cooling fan 29. Numeral $40_1$ designates a motor. The motor $40_1$ serves to drive conveyor belts $60_6$, $60_7$.

Figure 5:
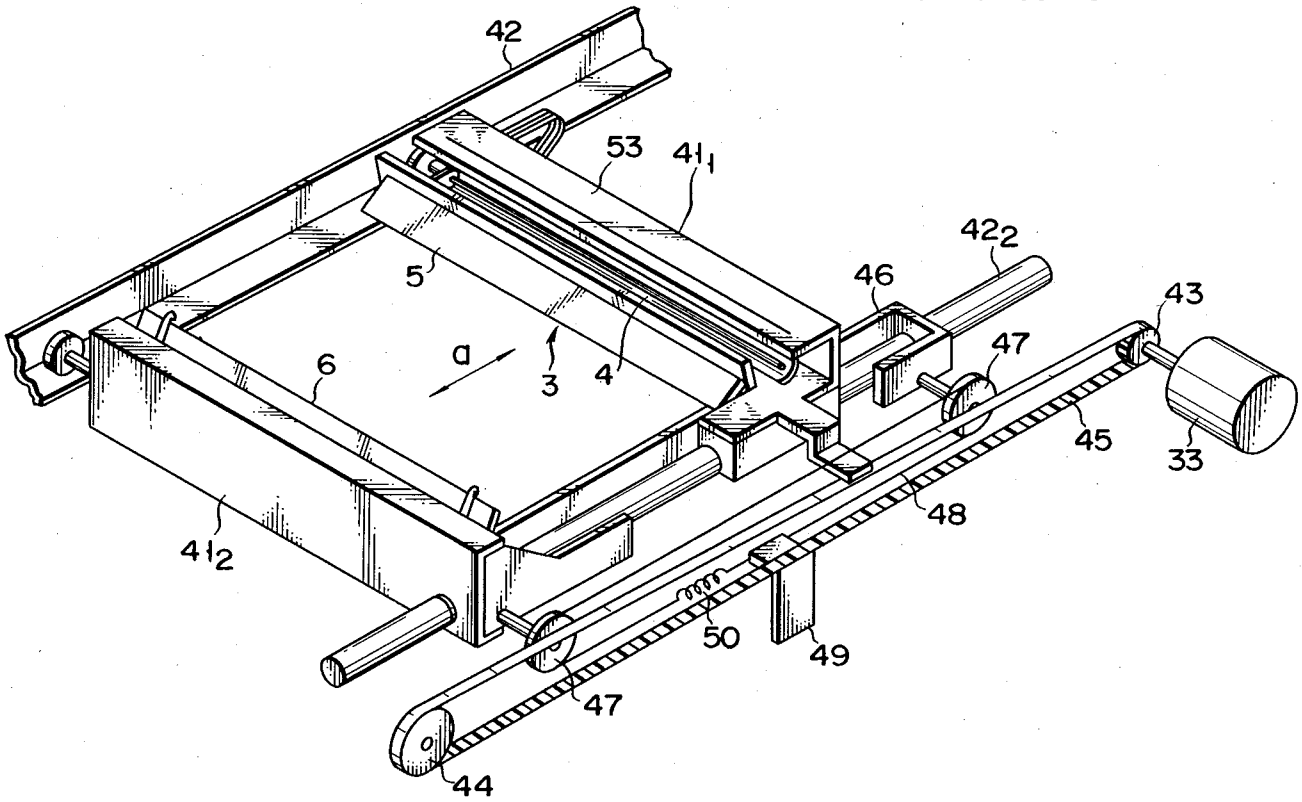

FIG. 5 shows a drive mechanism for reciprocating the optical system 3. The mirror 5 and the exposure lamp 4 are supported by a first carriage $41_1$, and the mirrors 6 and 7 by a second carriage $41_2$. These carriages $41_1$ and $41_2$ can move parallel in the direction indicated by arrow a, guided by guide rails $42_1$ and $42_2$. The four-phase pulse motor 33 drives a pulley 43. An endless belt 45 is stretched between the pulley 43 and an idle pulley 44, and one end of the first carriage 411 supporting the mirror 5 is fixed to the middle portion of the belt 45.

On the other hand, two pulleys 47 are rotatably attached to a guide portion 46 (for the rail 422) of the second carriage 412 supporting the mirrors 6 and 7, spaced in the axial direction of the rail $42_2$. A wire 48 is stretched between the two pulleys 47. One end of the wire 48 is connected directly to a fixed portion 49, while the other end is connected thereto by means of a coil spring 50. The one end of the first carriage 411 is fixed to the middle portion of the wire 48.

With this arrangement, when the pulse motor 33 is driven, the belt 45 turns around to move the first carriage $41_1$. As the first carriage $41_1$ travels, the second carriage $41_2$ also travels. Since the pulleys 47 then serve as movable pulleys, the second carriage $41_2$ travels in the same direction as and at a speed half that of the first carriage $41_1$. The traveling direction of the first and second carriages $41_1$ and $41_2$ is controlled by changing the rotating direction of the pulse motor 33.

The original table 2 carries thereon an indication of a reproducible range corresponding to the size of designated paper sheets. If the sheet size designated by the sheet selection keys $30_4$ and the copy ratio specified by the ratio setting keys $30_6$ or $30_7$ are (Px, Py) and K, respectively, the reproducible range (x, y) is given by:

$$x=Px/K,$$

$$y=Py/K.$$

Out of the coordinates (x, y) designating any point within the reproducible range, as shown in FIG. 1, the x coordinate is indicated by indexes 51 and 52 arranged on the inside of the original table 2, and the y coordinate by a scale 53 provided on the top face portion of the first carriage $41_1$.

Figure 6:
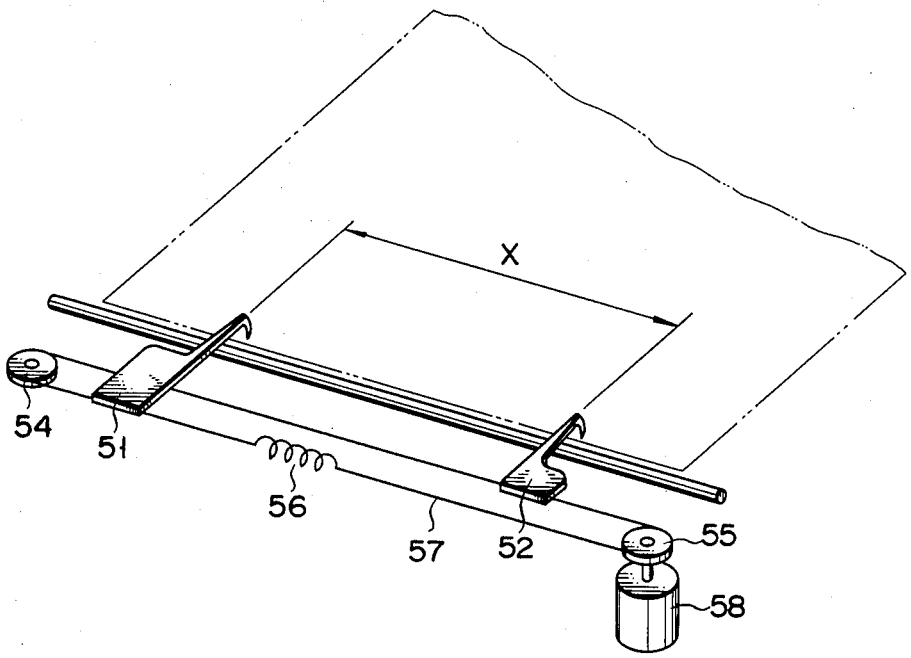

As shown in FIG. 6, the indexes 51 and 52 are attached to a wire 57 which is stretched between pulleys 54 and 55 through the aid of a spring 56. The pulley 55 is rotated by a motor 58. The distance between the indexes 51 and 52 can be changed by driving the motor 58 in accordance with the sheet size and the enlargement or reduction ratio.

The first carriage $41_1$ moves to a predetermined position (home position depending on the enlargement or reduction ratio) as the motor 33 is driven in accordance with the sheet size and the ratio. When the copy key $30_1$ is depressed, the first carriage $41_1$ is first moved toward the second carriage $41_2$. The lamp 4 is lighted and the first carriage $41_1$ is moved away from the second carriage $41_2$. When the original scanning ends, the lamp 4 is turned off, and the first carriage $41_1$ is returned to the home position.

Figure 7:
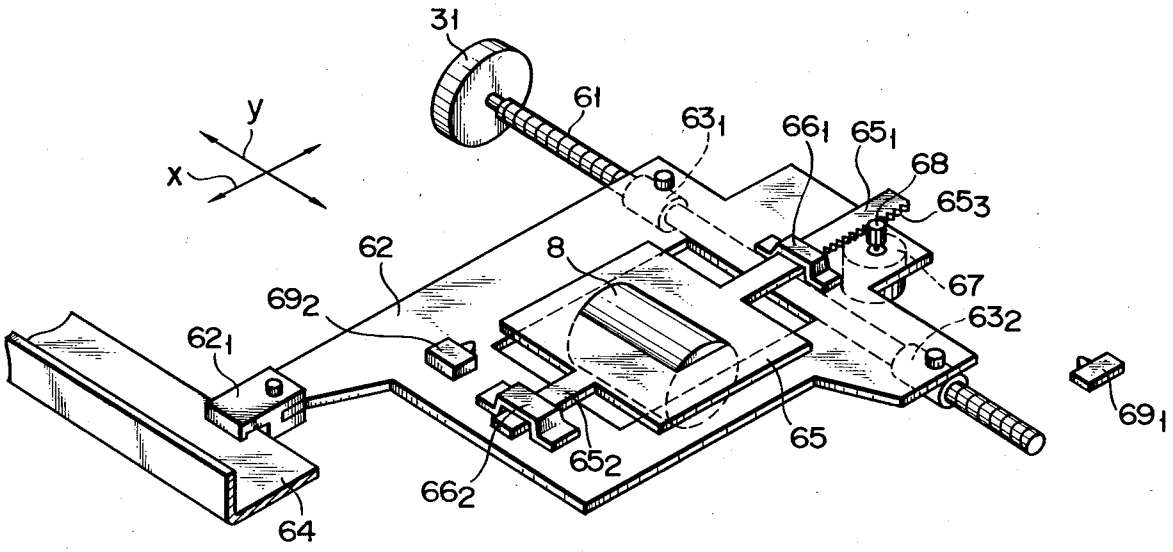

FIG. 7 shows a drive mechanism for block 8. Motor 31 drives lead screw 61 arranged along the moving direction (y direction) of carriage $41_1$. Bushings $63_1$ and $63_2$ disposed at one end of base plate 62 are meshed with screw 61. When screw 61 is rotated, plate 62 is moved along the y direction. Guide member $62_1$ is arranged at the other end of plate 62. Member $62_1$ is slidably engaged with guide rail 64. Movable member 65, upon which block 8 is mounted, is mounted on plate 62 and is movable along a direction (x direction) perpendicular to plate 62. Supports $65_1$ and $65_2$ are mounted at two ends of member 65 and are guided by guide members $66_1$ *and* $66_2$ mounted on plate 62. Rack $65_3$ is mounted on the side surface of support $65_1$ along its longitudinal direction. Pinion 68 is mounted on rack $65_3$ and can be rotated by pulse motor 67 mounted on plate 62. When motor 67 is driven, block 8 is moved along the x direction. It should be noted that microswitches $69_1$ and $69_2$ detect the initial positions of plate 62 and member 65, respectively.

Figure 8A:
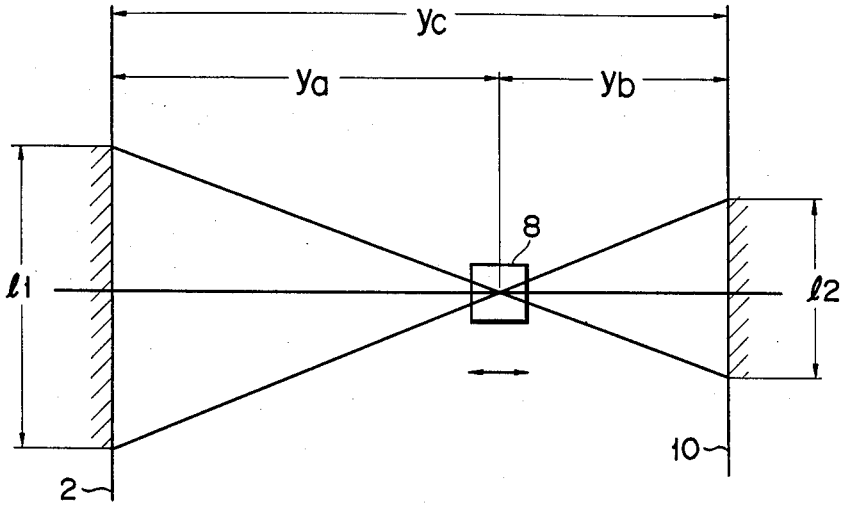
FIGS. 8A and 8B are representations for explaining the relationship between the variable lens block and the image to be formed.

The relationship between the operation of block 8 and the image to be formed will now be described. Referring to FIG. 8A, if the focal distance of block 8 is given by f, the optical path length between table 2 and block 8 is given by ya, the optical path length between block 8 and drum 10 is given by yb, and the overall optical path length between table 2 and drum 10 is given by yc, the following optical relation is derived:

$$1/f=1/ya+1/yb$$

A magnification K is thus given by:

$$K=yb/ya$$

Since focal distance f of block 8 is predetermined, it is apparent that length yc as well as length ya or yb must be changed to achieve the in-focus state in the variable magnification mode. Lengths ya and yb can be varied by moving block 8 in the y direction. Length yc can be varied by moving carriage $41_2$ and changing the positions of mirrors 6 and 7.

Figure 8B:
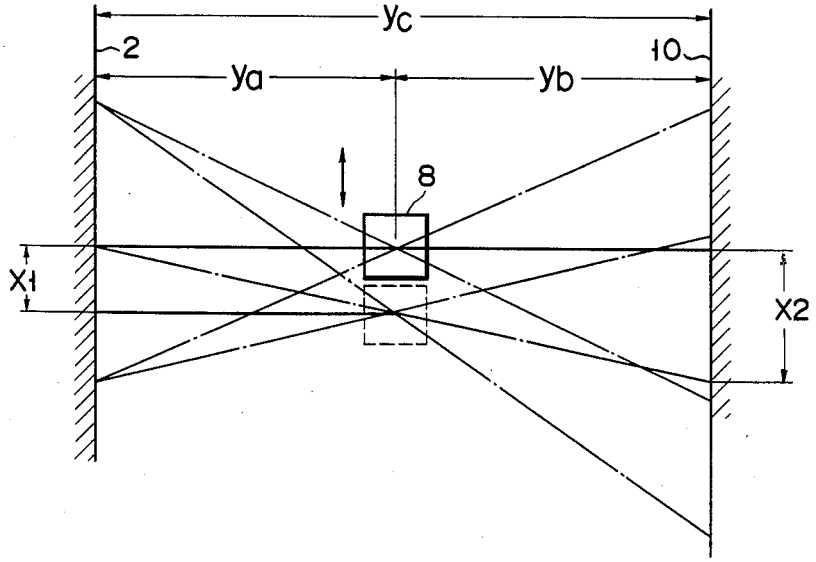

As shown in FIG. 8B, if the distances between table 2, block 8 and drum 10 are predetermined, and block 8 is moved by motor 67 by distance x1 along the x direction, an image on drum 10 can be shifted by distance x2, where x2 is given by:

$$x2=x1(yb/ya)$$

When an equal size mode is set, distance x2 is given by:

$$x2=2\times 1$$

In this manner, the center of the copied image can be shifted by moving block 8 along the x direction.

Figure 9:
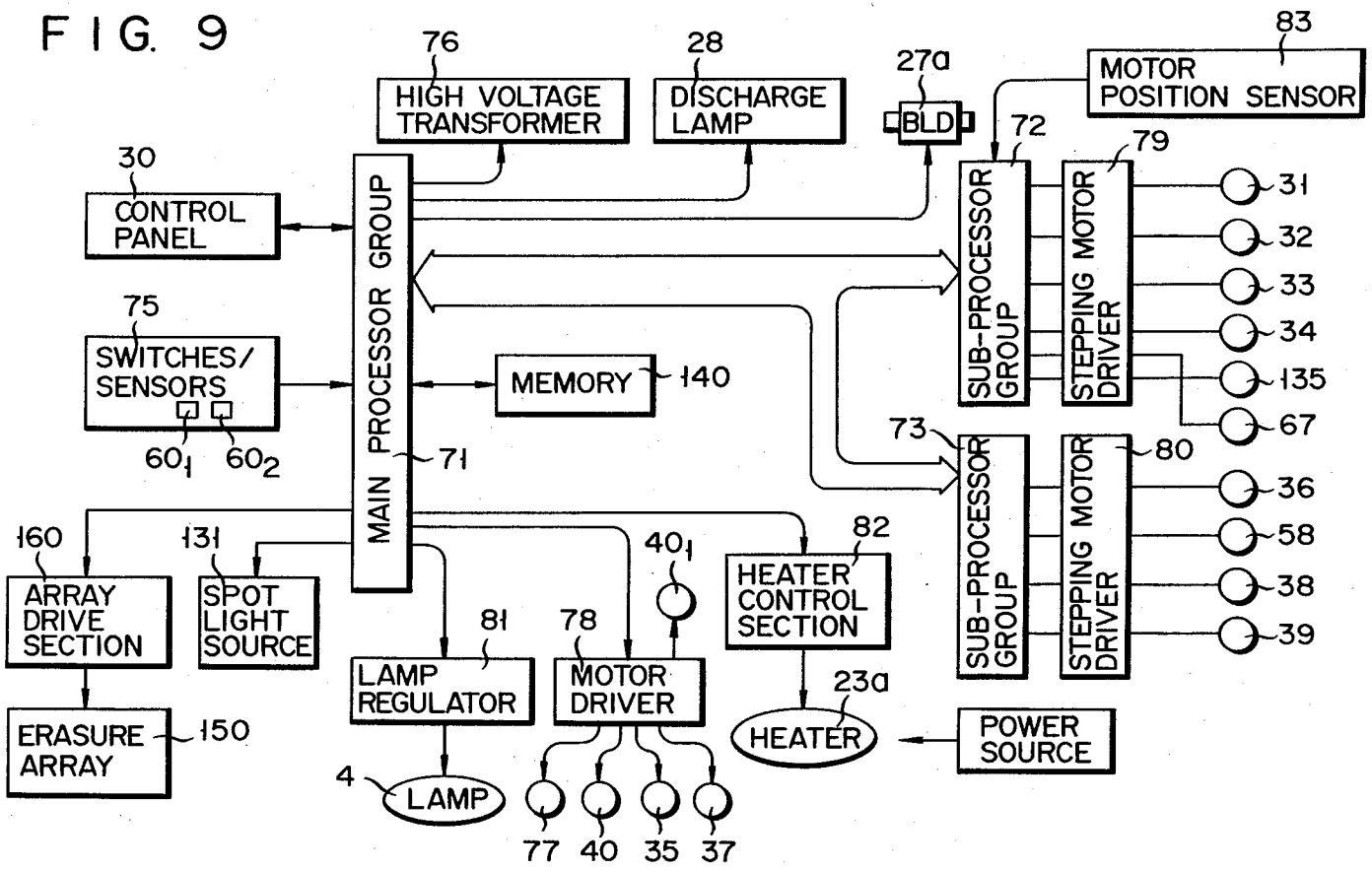

FIG. 9 shows a general control circuit of the electronic copying machine. This control circuit is mainly composed of a main processor group 71 and first and second sub-processor groups 72 and 73. The main processor group 71 detects input data from the control panel 30 and a group of input devices 75 including various switches and sensors, such as the cassette size detection switches 601 and 602, and controls a high-voltage transformer 76 for driving the chargers, the discharge lamp 28, a blade solenoid **27*a* of the cleaner 27, a heater 23*a* of the fixing roller pair 23, the exposure lamp 4, and the motors 31 to 40, 58, 67 and 77, thus accomplishing the copying operation. The main processor group 71 also controls a spot light source 131, a pulse motor 135, an erasure array 150, an array drive section 160, and a memory 160, thereby erasing any unnecessary portions of the original. These components 131, 135, 150, 160 and 140** will be described in detail later.

The motors 35, 37 and 40, $40_1$ and a toner-supply motor 77 for supplying the toner to the developing unit 12 are connected through a motor driver 78 to the main processor group 71 to be controlled thereby. The motors 31 to 34, 67 and 135 are connected through a stepping motor driver 79 to the first subprocessor group 72 to be controlled thereby. The motors 36, 38, 39 and 58 are connected through a stepping motor driver 80 to the second subprocessor group 73 to be controlled thereby.

Further, the exposure lamp 4 is controlled by the main processor group 71 through a lamp regulator 81, and the heater **23*a* by the main processor group 71 through a heater control section 82. The main processor group 71 gives instructions for the start or stop of the individual motors to the first and second sub-processor groups 72 and 73. Thereupon, the first and second sub-processor groups 72 and 73 feed the main processor group 17 with status signals indicative of the operation mode of the motors. Also, the first sub-processor group 72 is supplied with positional information from a position sensor 83 for detecting the respective initial positions of the motors 31 to 34, 67 and 135**.

Figure 10:
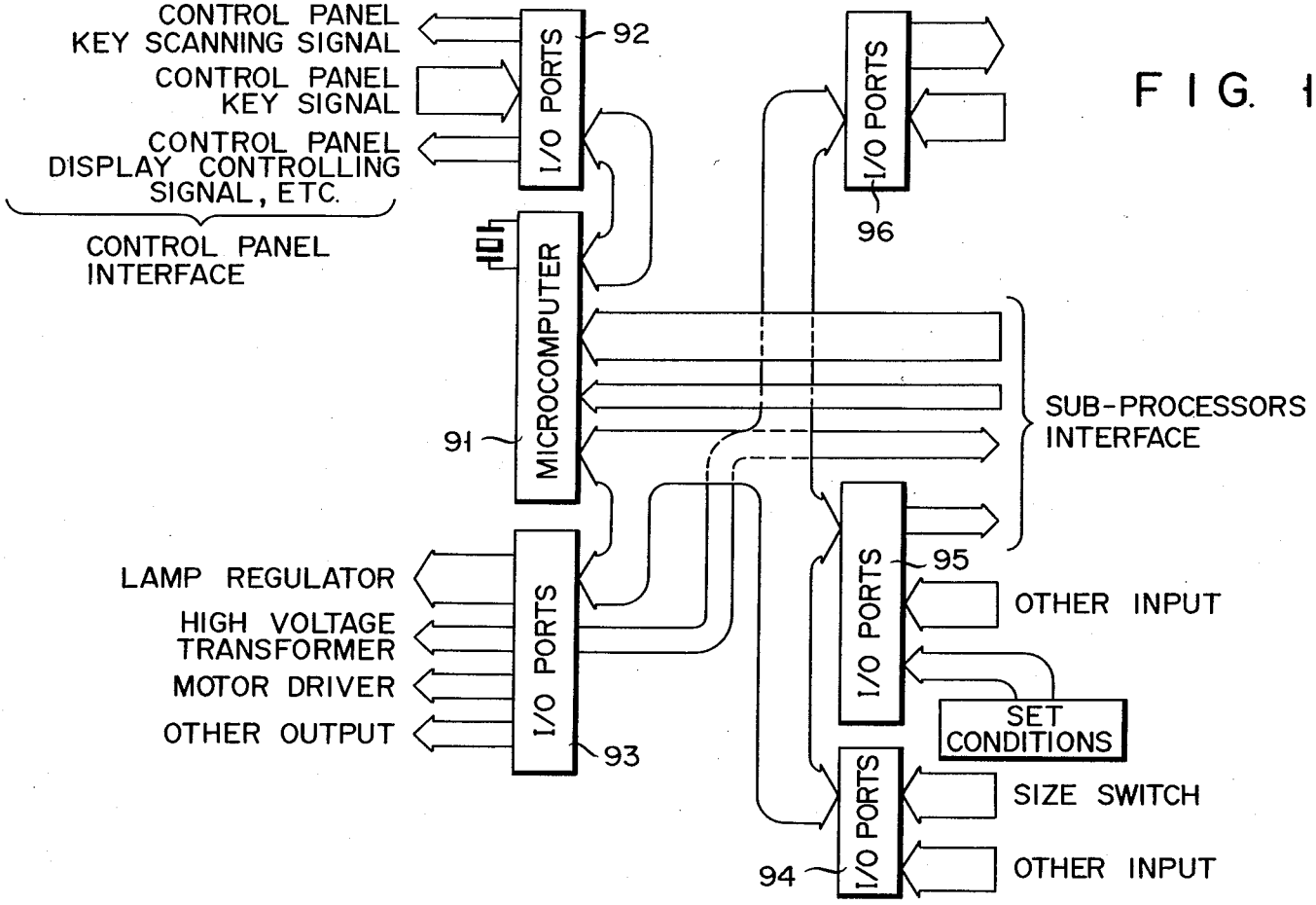

FIG. 10 shows an arrangement of the main processor group 71. Reference numeral 91 denotes a one-chip microcomputer (to be referred to as a CPU hereinafter). The CPU 91 detects key inputs at a control panel (not shown) through an I/O port 92 and controls display operations. The CPU 91 can be expanded through I/O ports 93 to 96. The port 93 is connected to a high-voltage transformer 76, a motor driver 78, a lamp regulator 81 and other outputs. The port 94 is connected to a size switch for detecting a paper size and other inputs. The port 95 is connected to a copying condition setting switch and other inputs. The port 96 is optional.

Figure 11:
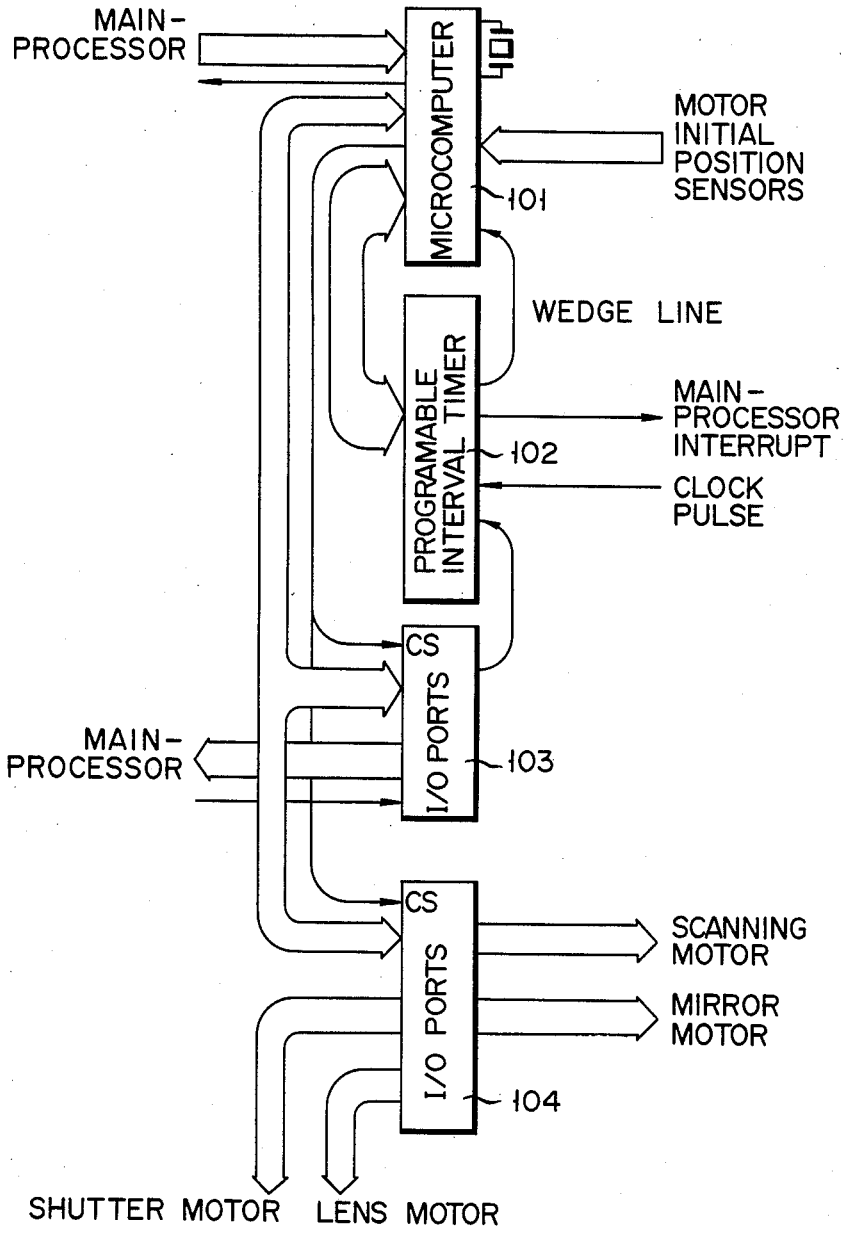

FIG. 11 shows an arrangement of the first subprocessor group 72. Reference numeral 101 denotes a CPU connected to the group 71. Reference numeral 102 denotes a programable interval timer for controlling switching time intervals. A preset value from the CPU 101 is set in the programable interval timer, and the timer is started. When the timer is stopped, the timer sends an end pulse onto an interrupt line of the CPU 101. The timer 102 receives a reference clock pulse. The CPU 101 receives position data from a position sensor 83 and is connected to I/O ports 103 and 104. The port 104 is connected to motors 31 to 34, 67 and 135 through the stepping motor driver 79. The port 103 is used to supply a status signal from each pulse motor to the group 71.

Figure 12:
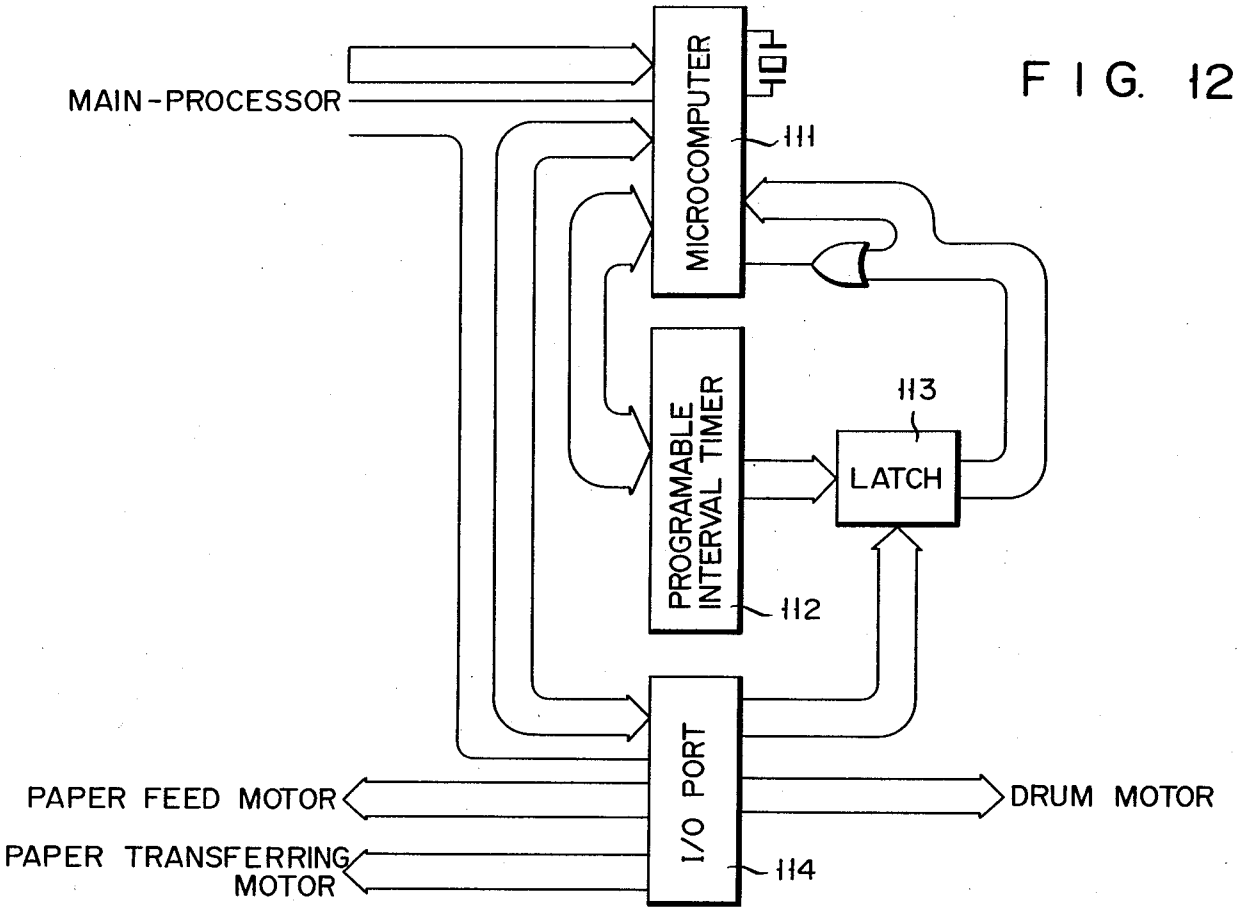

FIG. 12 shows an arrangement of the second subprocessor group 73. Reference numeral 111 denotes a CPU connected to the group 71. Reference numeral 112 denotes a programable interval timer for controlling switching time intervals of the pulse motors. A preset value from the CPU 111 is set in the programable interval timer, and the timer is started. When the timer is stopped, it generates an end pulse. The end pulse is latched by a latch 113, and an output therefrom is supplied onto the interrupt line of the CPU 111 and the input line of the I/O port. The CPU 111 is connected to an I/O port 114 which is then connected to motors 36, 38, 39 and 58 through the driver 80.

Figure 13:
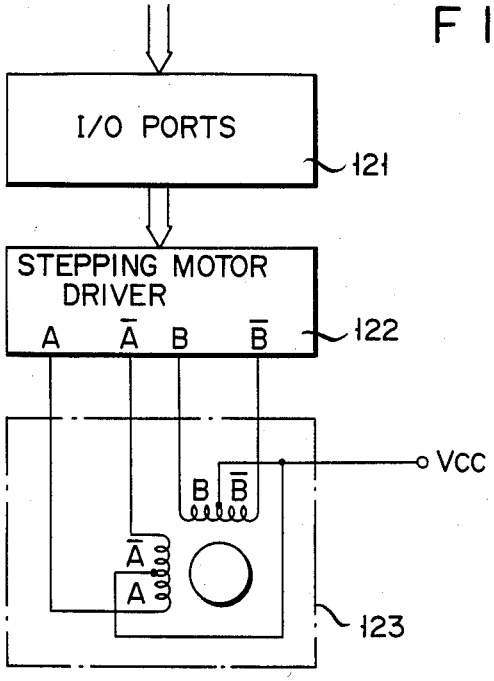

FIG. 13 shows a pulse motor control circuit. An I/O port 121 (corresponding to the ports 104 and 114 of FIGS. 11 and 12) is connected to a stepping motor driver 122 (corresponding to the drivers 79 and 80 of FIG. 9). The driver 122 is connected to windings A, $\overline{A}$, B and $\overline{B}$ of a stepping motor 123 (corresponding to the motors 31 to 34, 36, 38, 39, 58, 67 and 135).

Figure 14:
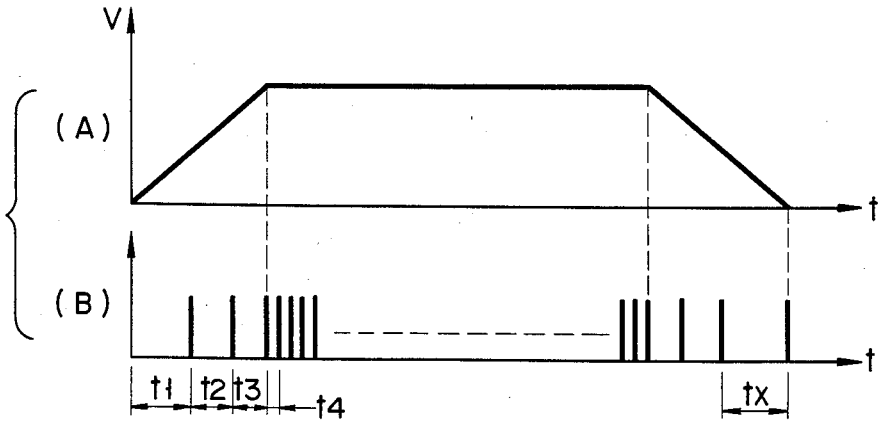

FIGS. 14A and 14B show a method of controlling a stepping motor speed. FIG. 14A shows a stepping motor speed curve, and FIG. 14B shows switching intervals. As is apparent from FIGS. 14A and 14B, the switching intervals are long at the beginning, are gradually decreased, and finally stop to decrease. Then, the intervals are prolonged, and the stepping motor is finally stopped. This cycle indicates the through-up and through-down of the pulse motor. The motor is started from the self starting region, operated in a high-speed region and is gradually stopped. Reference symbols $t_1$, $t_2$, . . . $t_x$ denote times between the switching intervals.

Indicating means and erasing means according to the present invention will now be described in detail.

Figure 15:
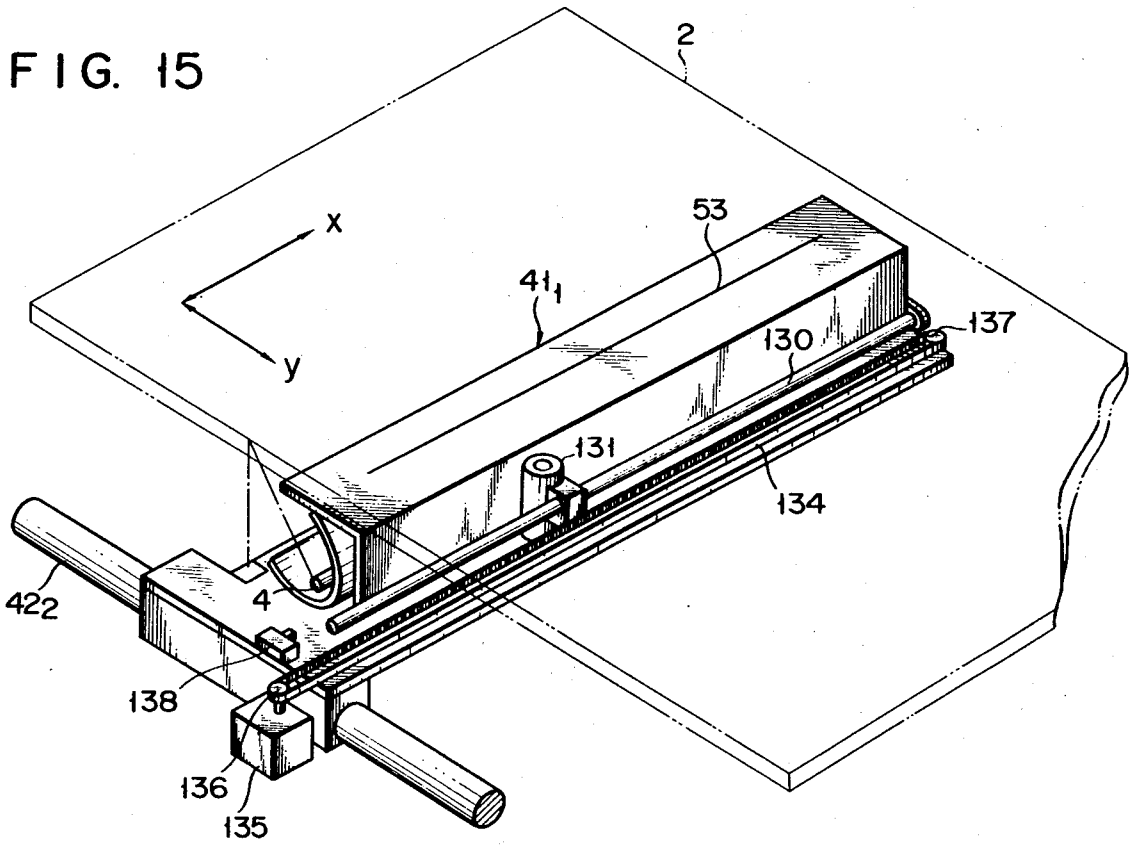
Figure 16:
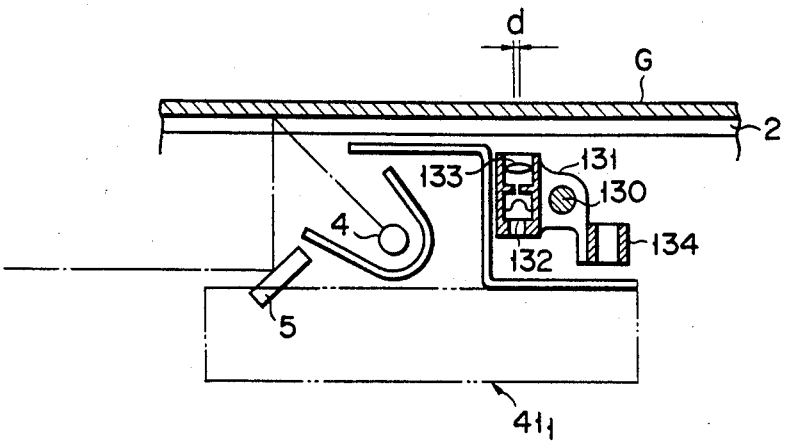
Figure 17:
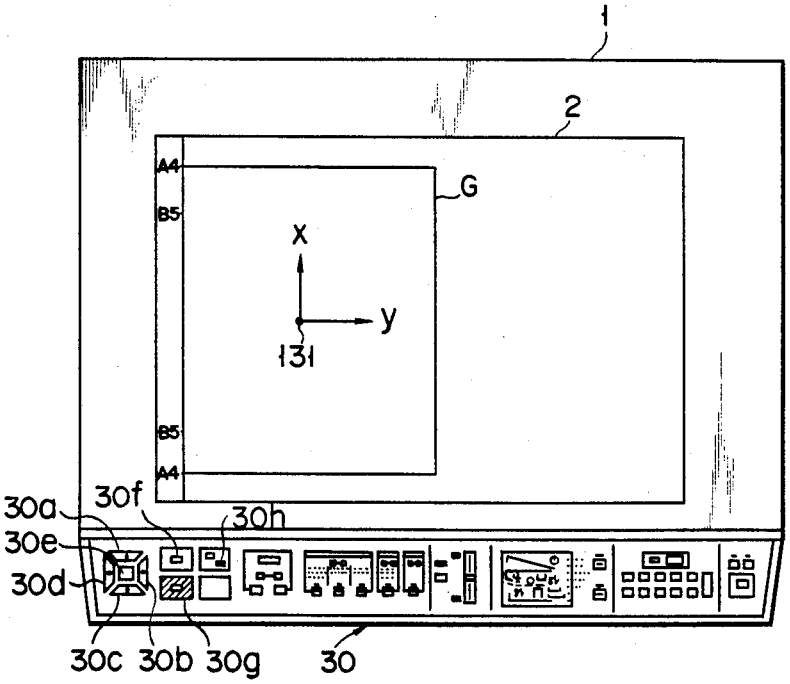

In FIGS. 15 and 16, a guide shaft 130 is disposed at that portion of the first carriage $41_1$ intercepting the light from the lamp 4, extending along the lamp 4. The guide shaft 130 is movably fitted with the spot light source 131 as the indicating means for indicating an erasure range of the original. As shown in FIG. 16, the spot light source 131 includes a light emitting element 132, such as a light emitting diode or lamp, and a lens 133 which are opposed to the original table 2.

A light beam emitted from the light emitting element 132 is applied to the original table 2 through the lens 133, as a spot light with a diameter d of, e.g., 2 mm. The spot light has enough brightness to be transmitted through an original G as thick as, e.g., a postcard set on the original table 2. The spot light source 131 is coupled to a timing belt (toothed belt) 134 extending along the guide shaft 130. The timing belt 134 is stretched between a pulley 136 mounted on the shaft of the stepping motor 135 and a driven pulley 137. As the stepping motor 135 is rotated the spot light source 131 is moved in a direction perpendicular to the scanning direction of the first carriage $41_1$.

A position sensor 138 formed of a microswitch for detecting the initial position of the spot light source 131 is attached to that portion of the first carriage $41_1$ which is located beside the end portion of the guide shaft 130 on the side of the stepping motor 135. When the spot light source 131 is moved, for example, it first abuts against the position sensor 138 to have its initial position detected thereby.

Referring now to FIGS. 17 to 21, there will be described a method for designating as the erasure range an unnecessary portion of the original by means of the spot light source 131.

The spot light source 131 is moved by operating the operation keys 30*a* to 30*d*. When the operation keys 30*b* and 30*d* are depressed, the motor 33 is started, and the first carriage $41_1$ and the spot light source 131 are moved in the scanning direction (indicated by arrow y in FIG. 17). When the operation keys 30*a* and 30*c* are depressed, on the other hand, the motor 135 is started, and the spot light source 131 is moved in a direction (indicated by arrow x in FIG. 17) perpendicular to the scanning direction.

Figure 18:
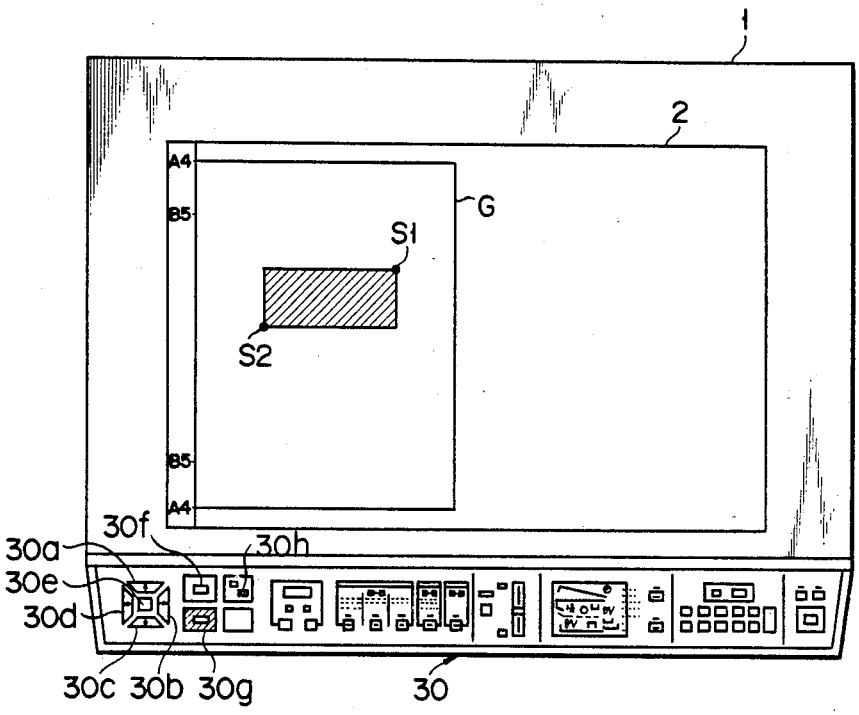

Observing the spot light transmitted through the original G, the operator operates the operation keys 30*a* to 30*d*. When the spot light reaches, for example, a spot S1 on the original G shown in FIG. 18, the operator depresses the position designating key 30*e*. Thereupon, the coordinate position indicated by the spot S1 is stored in the main processor group 71 shown in FIG. 9. Likewise, if the position designating key 30*e* is depressed when a spot S2 on the original G is reached by the spot light, the position of the spot S2 is stored in the main processor group 71. This position of the spot light can be detected by, for example, counting drive pulses delivered from the stepping motors 33 and 135. When the erasure range designating key 30*f* is depressed thereafter, a rectangular region (hatched region) having its two opposite vertexes on the spots S1 and S2 is designated as the erasure range, as shown in FIG. 18.

Figure 19:
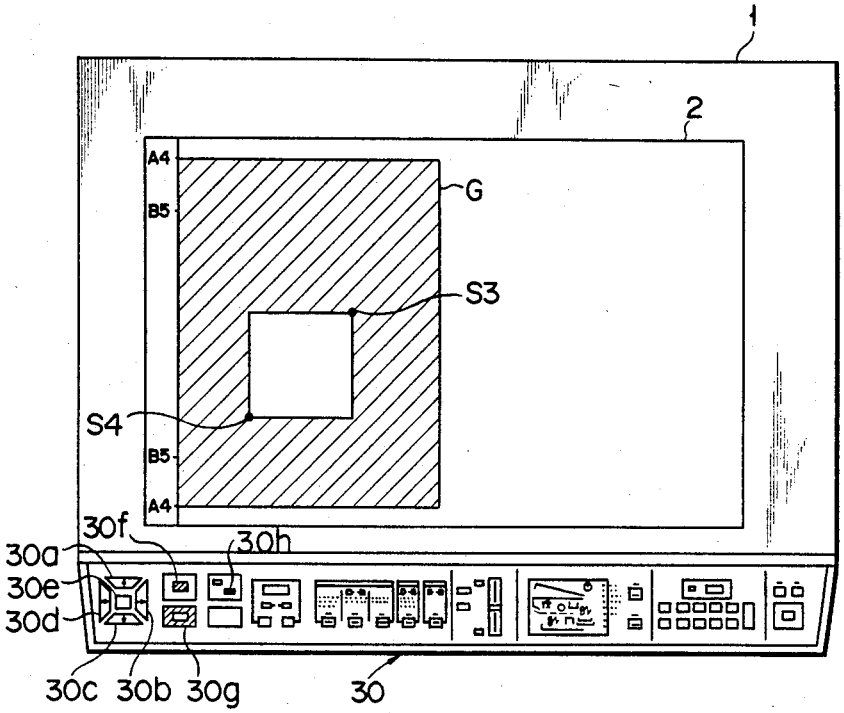

If the erasure range designating key 30*g* is depressed after designating spots S3 and S4 on the original G, the other region of the original G (i.e. not a square region having its two opposite vertexes on the spots S3 and S4) is designated as the erasure range, as shown in FIG. 19. Thus, if the erasure range designating key 30*f* or 30*g* is depressed, the main processor group 71 executes calculation in accordance with the positions of the two designated spots, and high- and low-level signals "1" and "0" are stored in those addresses of the memory 140 for the erasure range and the remaining region, respectively.

Figure 20:
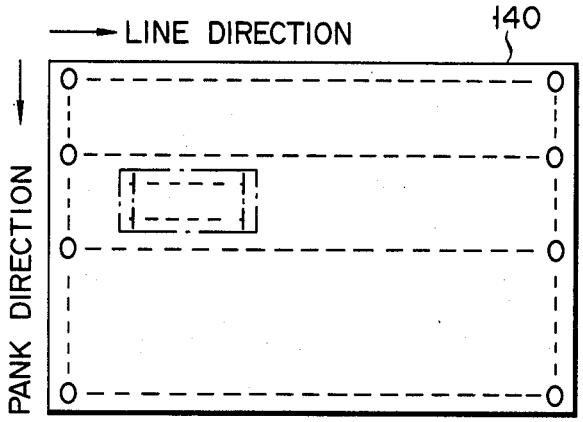
Figure 21:
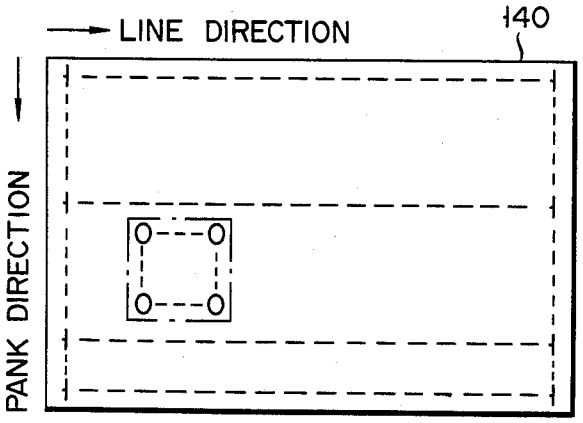

A rank capacity of the memory 140 substantially corresponds to a value given by (moving distance of the source 131 along the x direction)÷(position resolution along the x direction). A line capacity of the memory 140 substantially corresponds to a value given by (moving distance of the source 131 along the y direction)÷(position resolution thereof along the y direction). The memory 140 comprises a RAM having the memory capacity described above. In the cases of FIGS. 18 and 19, high level signals are stored at addresses corresponding to the hatched area and low level signals are stored at other addresses in response to the data supplied from the group 71, as shown in FIGS. 20 and 21, respectively.

In this manner, the original is placed on the original table such that the image surface faces upward. When an erasure area is specified, the original is turned over along fixed scale $2_1$ on table 2. Therefore, information stored in memory 140 shown in FIGS. 20 and 21 is stored such that column order is inverted in practice.

Figure 22A:
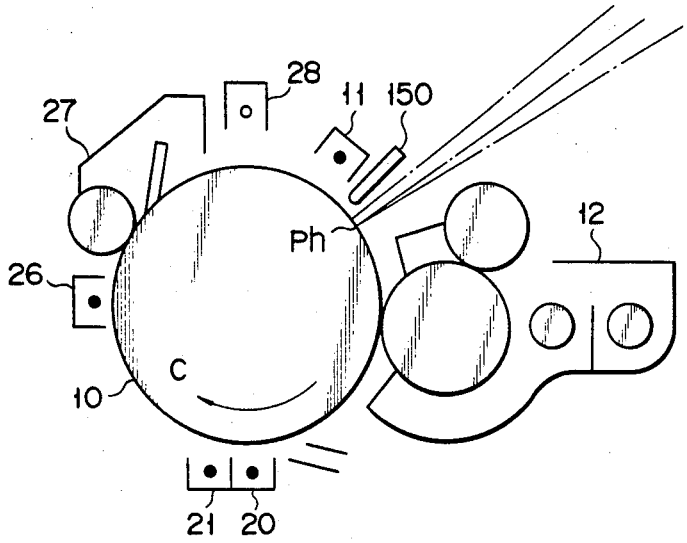
FIG. 22A is a side sectional view of the principal part showing an arrangement of the erasure array.
Figure 23:
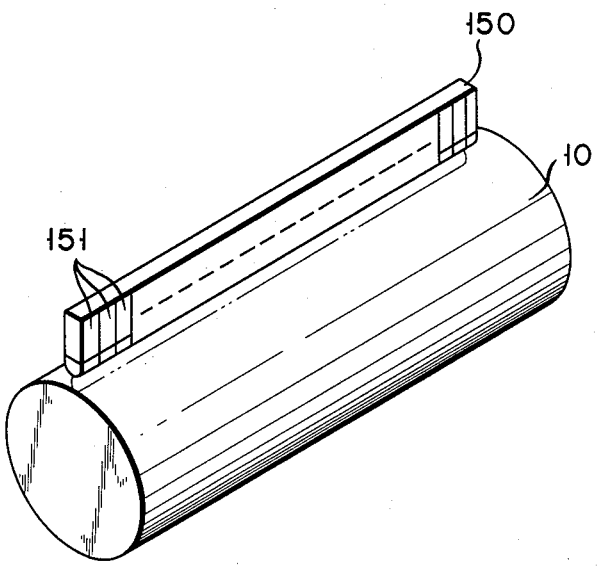
Figure 24:
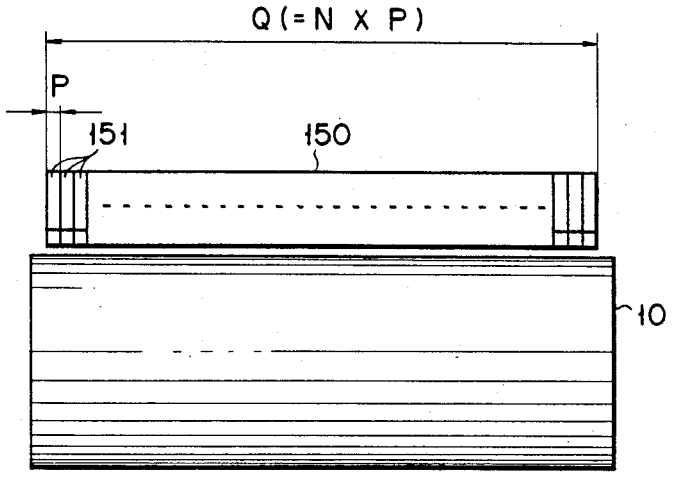
Figure 25A:
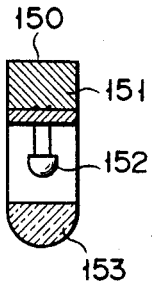
FIG. 25A is a side sectional view of the erasure array.
Figure 25B:
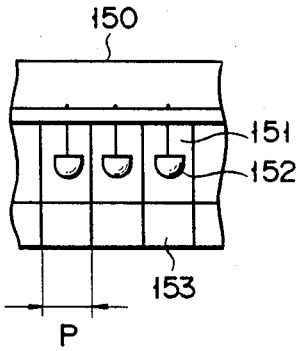
FIG. 25B is a partial front view of the erasure array.

As shown in FIG. 22A, on the other hand, the erasure array 100 as the erasing means is disposed close to the photosensitive drum 10, between the charger 11 and an exposure region Ph, for example. As shown in FIGS. 23 and 24, the erasure array 150 includes a plurality of shading cells 151 which are arranged in a direction perpendicular to the rotating direction of the photosensitive drum 10. As shown in FIGS. 25A and 25B, the cells 151 each contains therein a light emitting element 152 formed of, e.g., a light emitting diode. Moreover, a lens 153 for converging light from the light emitting element 152 on the surface of the photosensitive drum 10 is disposed at the opening portion of each cell 151 facing the photosensitive drum 10.

The number of light-emitting elements arranged in erasure array 150 corresponds to the same as the column capacity of memory 140. When the distance between light-emitting elements 152 is given by P and the number of elements is given by N, overall length Q of array 150 is given by $Q=N\cdot P$.

Figure 26:
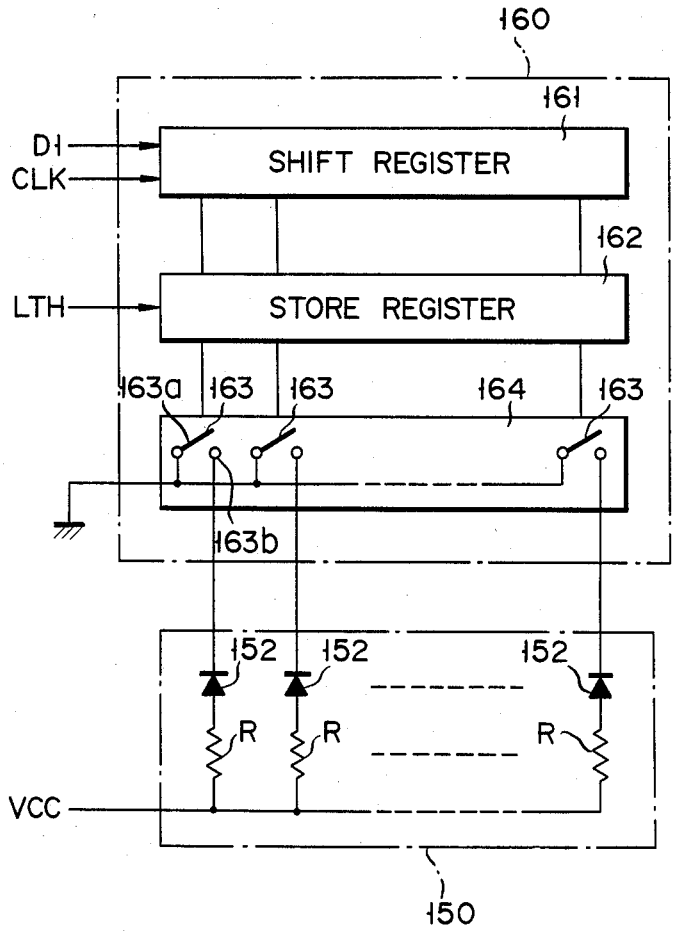

The array 150 is driven by an array drive section 160. As shown in FIG. 26, the section 160 comprises a shift register 161 having the same bit number as the rank bit number of the memory 140, a store register 162 for storing the content of the register 161, and a switching circuit 164 consisting of a plurality of switch elements 163 which are turned on/off in response to output signals from the register 162. Movable contacts **163*a* of the elements 163 are grounded, and stationary contacts 163*b* thereof are respectively connected to the cathodes of the elements (diodes) 152 constituting the array 150. The anodes of the elements 152** are connected to a power source VCC through the corresponding current limiting resistors R.

After, as the erasure area the unnecessary portion of the original is specified, he closes the original cover $1_1$ and depressed the key $30_1$. The carriage $41_1$ and drum 10 are driven, and one-rank data are sequentially read out along the line direction (FIGS. 20 and 21) of the memory 140. The readout data D1 are transferred to the register 161 in the section 160 in response to the clock signal CLK. After one-rank data is transferred to the register 161 and the charged portion of the drum 10 reaches the array 150, the group 71 generates a latch signal LTH. The storage data is supplied from the register 161 to the register 162 in response to the latch signal LTH. Since the array 150 is arranged between the charger 11 and the exposure portion Ph, the output timing of the latch signal LTH is controlled such that the one-rank data is transferred from the memory 140 to the register 162 prior to $\theta 1/\omega$ where $\theta 1$ is the angle between the array 150 and the portion Ph and $\omega$ is the peripheral velocity of the drum 10.

The elements 163 in the circuit 164 are controlled in response to the output signal from the register 162. When the output of the register 162 is set at high level, the elements 163 are turned on. When the output of the register 162 is set at low level, the elements 163 are turned off. The elements 152 connected to the elements 163 are turned on when the elements 163 are turned on. Otherwise, the elements 152 are turned off. A charged drum portion corresponding to the ON elements 152 is discharged, and the remaining portion is not discharged, so that a latent image is not formed in the discharged portion even if the surface of the drum 10 is exposed with light. In this manner, the unnecessary portion for one rank is erased. The data is thus read out from the memory 140 in units of ranks, thereby erasing the unnecessary image portion.

Figure 27:
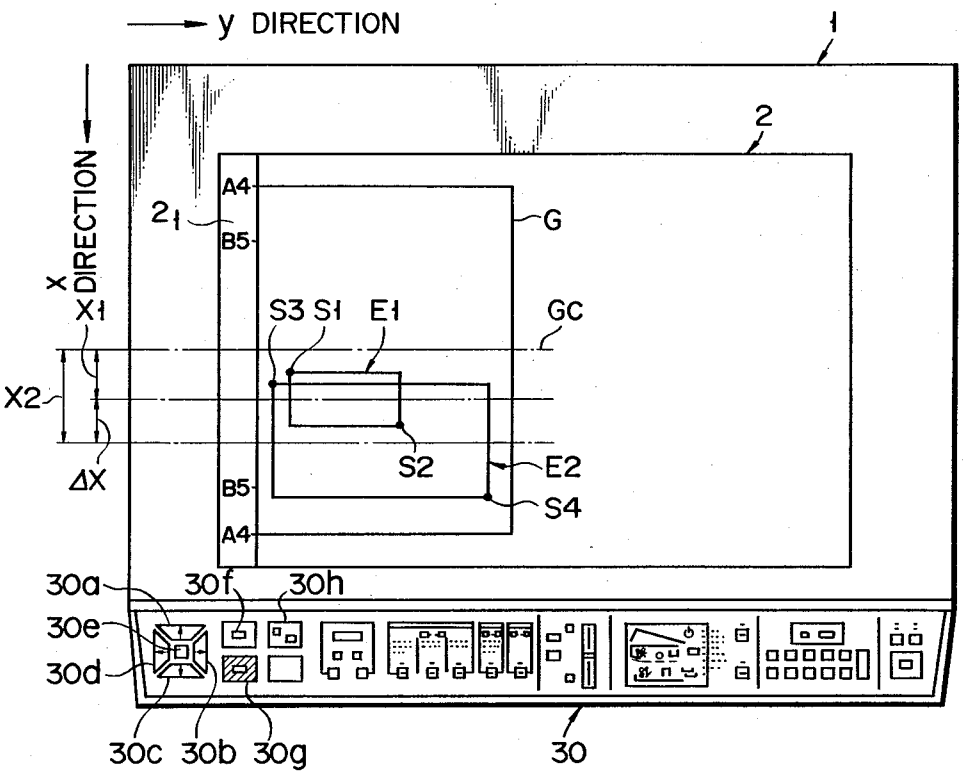

The principal part of the first embodiment of the present invention will now be described. The copying machine can edit the original and copy the resulting edited image. In other words, a desired portion of the original can be shifted to another portion of the same original, and the resulting image can be copied. For example, as shown in FIG. 27, an image in first area E1 of original G set on table 2 can be shifted to second area E2 and can be copied in this portion.

Figure 28A:
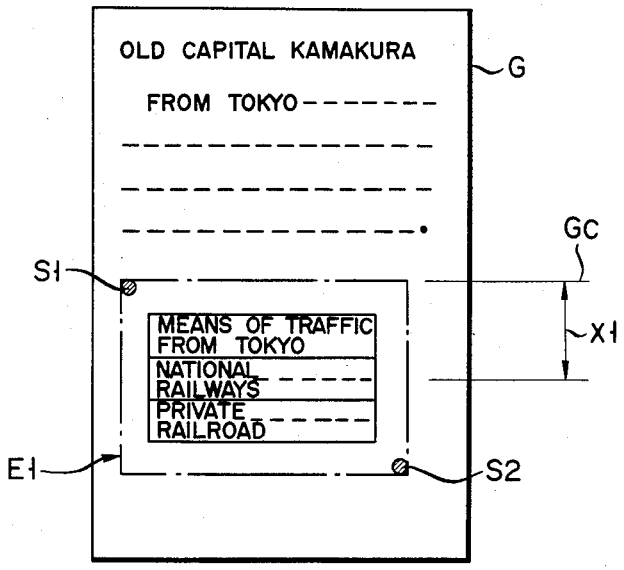
Figure 28B:
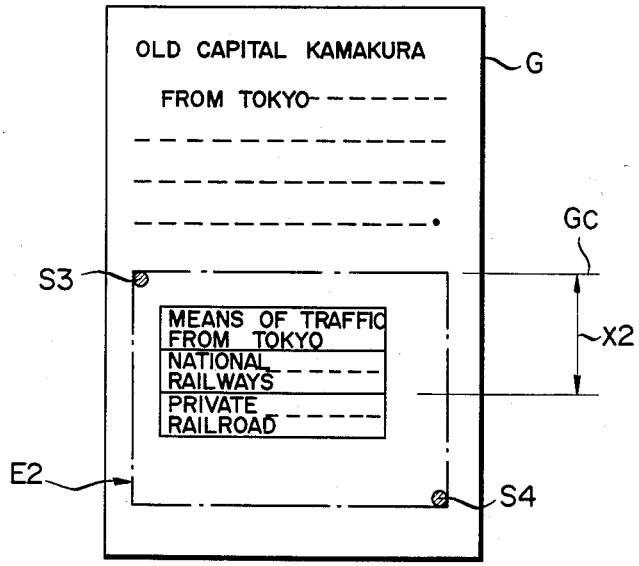

The editing and copying operation will now be described with reference to FIGS. 28A to 28E. The operator uses keys **30*a* to 30*d* and 30*e*. Area E1 is specified with light spots S1 and S2, as shown in FIG. 28A. Similarly, area E2 is specified with light spots S3 and S4, as shown in FIG. 28B. Original G is set with respect to central portion Gc of scale $2_1$. When areas E1 and E2 are specified, distances x1 and x2 (the distances between Gc and the central portion of area E1 and between Gc and the central portion of area E2) can be detected. When the operator depresses key 30*h* after areas E1 and E2 are specified, difference $\Delta x$ ($\Delta x=x2-x1$) is calculated by main processor group 71 in accordance with the coordinate data of light spots S1 to S4. Difference $\Delta x$ corresponds to the displacement of block 8 along the x direction. Group 71** also calculates x and y lengths defined by coordinates (xE1,yE1) and (xE2,yE2) in accordance with the coordinate data of spots S1 and S2 and spots S3 and S4, and then calculates x and y magnifications Kx and Ky as follows:

$$Kx=xE2/xE1$$

$$Ky=yE2/yE1$$

When the x magnification differs from the y magnification, a smaller magnification is selected so that 100% of the image in area E1 is copied in area E2.

Figure 28C:
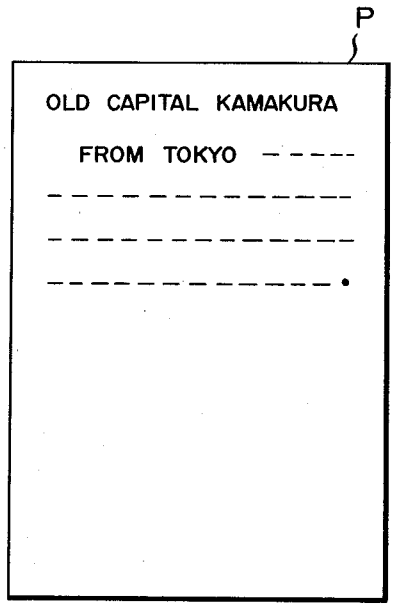
Figure 28D:
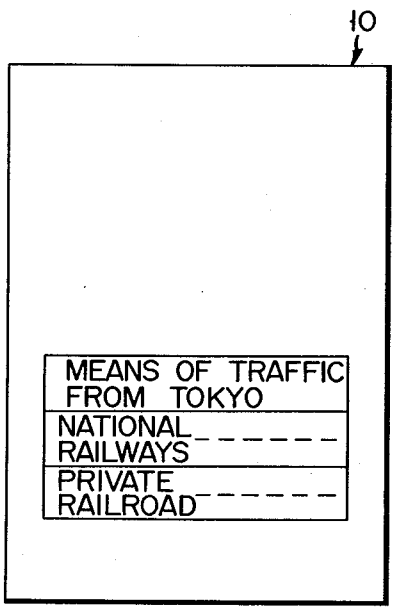
Figure 28E:
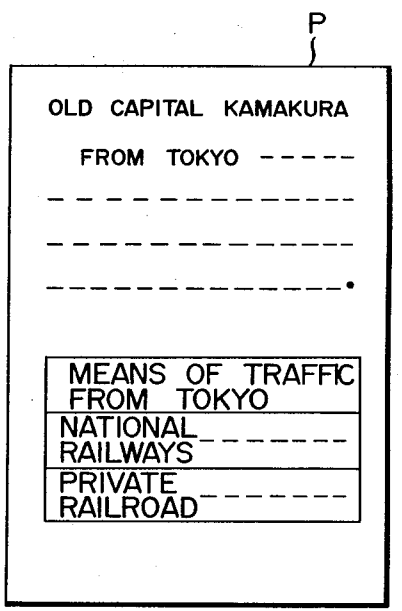

Upon depressing key $30_1$, carriage $41_1$ is moved to perform the same operation as when key **30*f* is depressed. That is, the image in area E1 is erased, and the resulting image is copied. FIG. 28C shows the resulting image copied on sheet P. Sheet P is fed back by belts $60_6$ and $60_7$ of multicopying unit $60_3$ to the transfer section. Meanwhile, carriage $41_1$ is returned to the home position, and block 8 is moved by pulse motors 67 and 31** to a predetermined position designated by difference $\Delta x$ and magnifications Kx or Ky calculated by group 71. Sheet P is fed from a paper cassette is synchronism with carriage $41_1$, and the same operation as when key 30g is depressed is performed. More specifically, as shown in FIG. 28D, an image excluding the portion specified by area E2 is erased from the latent image formed on drum 10. The image in area E1 is enlarged and copied in area E2. In this manner, the image formed on drum 10 is formed on the portion of sheet P specified by area E2 and on the same side as the portion specified by area E1, thus obtaining the image as shown in FIG. 28E. Sheet P is discharged to tray 25 through fixing roller pair 23 and discharge roller pairs 24 and $60_4$, thereby completing the editing and copying operation.

According to the first embodiment described above, an unnecessary portion of the original can be specified and erased. At the same time, an image in the first area of the original can be enlarged or reduced and shifted to the second area. Therefore, the original image can be edited in a variety of ways.

Spot light source 131 is arranged in carriage $41_1$ so that space can be effectively utilized and an increase in apparatus size prevented. At the same time, since a predetermined area of the original can be specified on table 2, good operability is guaranteed.

According to the above embodiment, in the editing/-copying mode, the image portion in area E1 is erased and the resulting image is copied. The image in area E1 is then formed in area E2 of the same sheet. However, the editing/copying mode is not limited to this. For example, the image in area E2 can first be erased, and the resulting image is copied. The image of the portion specified by area E1 can then be formed in area E2 of the same sheet.

According to the first embodiment of the present invention, an image forming apparatus is provided wherein any portion of the original image can be selectively erased, enlarged, reduced, or shifted, thereby forming an edited image.

A second embodiment of the present invention will be described hereinafter. If no description is given, the constitution of the second embodiment is the same as that of the first embodiment.

Figure 29:
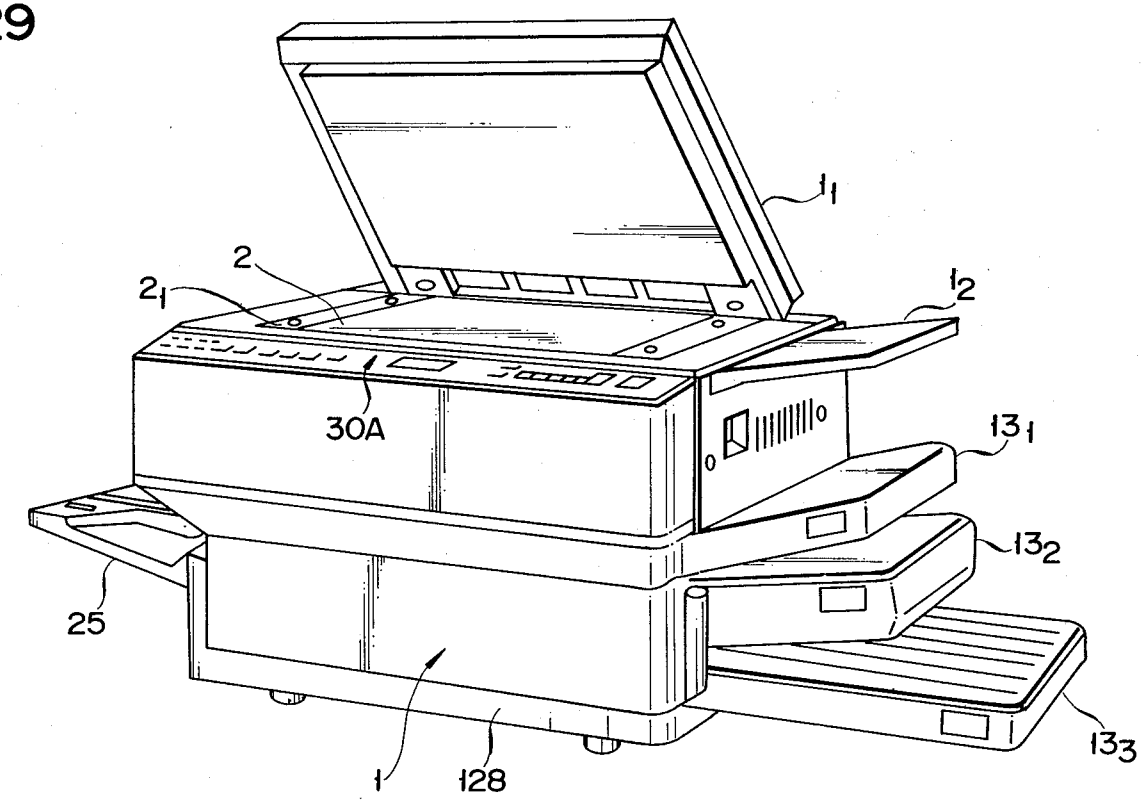
Figure 30:
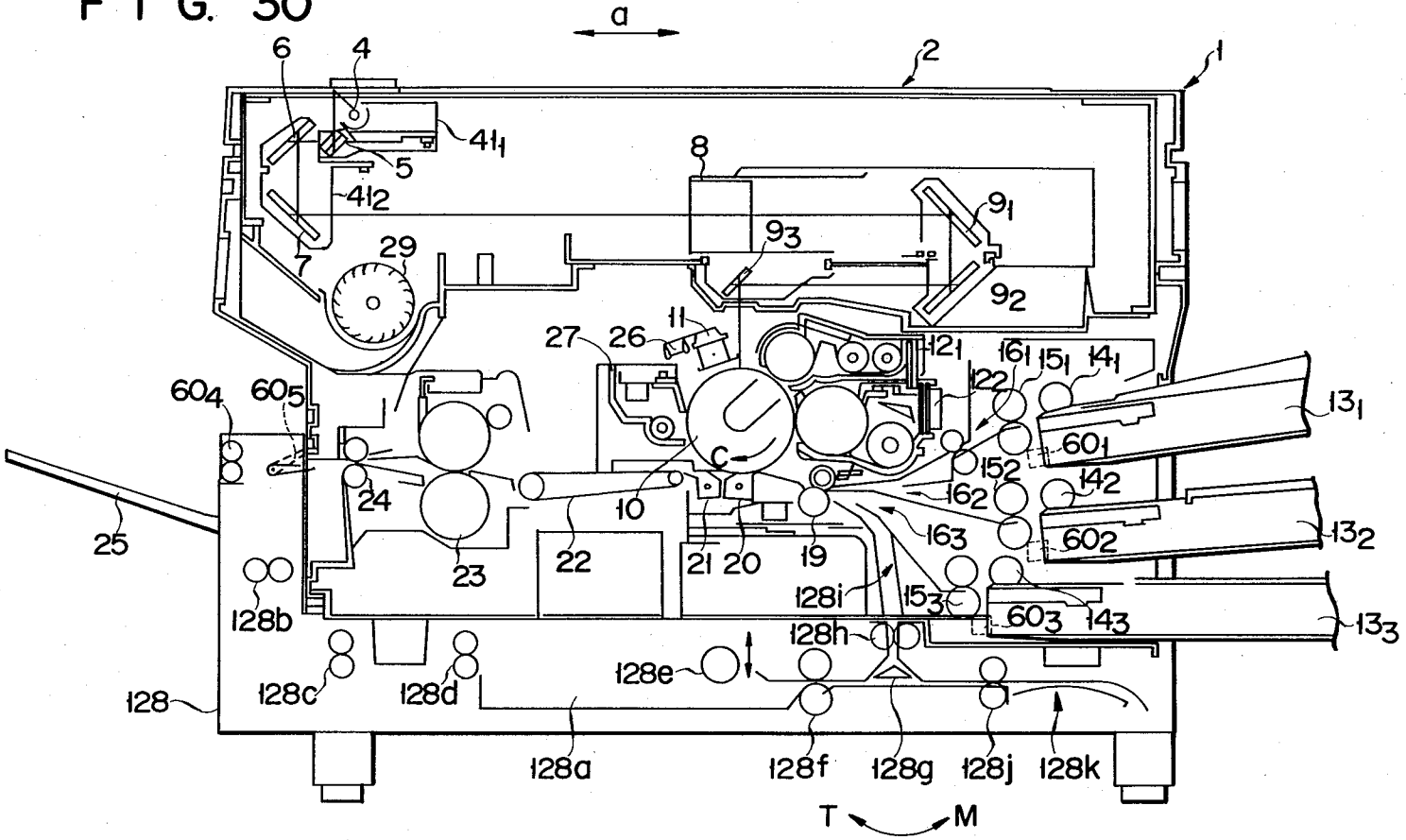

Referring to FIGS. 29 and 30 showing the schematic arrangement of the copying machine of the second embodiment, light is reflected by an original upon scanning by the optical system. Light reflected by the original upon illumination by exposure lamp 4 is reflected by mirrors 5, 6 and 7 and is transmitted through variable lens block 8. The transmitted light is reflected by mirrors $9_1$, $9_2$ and $9_3$ and is guided to photosensitive drum 10, so that an image of the original can be formed on the surface of drum 10. The latent image formed on drum 10 is applied with red or black toner by developing units $12_1$ and $12_2$, which are selectively operated so that the latent image can be produced as a visible image. Meanwhile, sheets (image forming media) P are selectively fed by feed rollers $14_1$, $14_2$ and $14_3$ and roller pairs $15_1$, $15_2$ and $15_3$ from upper, middle and lower cassettes $3_1$, $13_2$ and $13_3$ one by one. Each sheet is guided to aligning roller pair 19 along guide path $16_1$, $16_2$ or $16_3$ and is fed by pair 19 to the transfer section. It should be noted that cassettes $13_1$, $13_2$ and $13_3$ are detachably attached to the lower portion at the right side of housing 1. One of the cassettes must be selected at the operation panel (to be described later). Sizes of cassettes $13_1$, $13_2$ and $13_3$ are detected by cassette size detection switches $60_1$, $60_2$ and $60_3$, respectively. Switches $60_1$, $60_2$ and $60_3$ comprise a plurality of microswitches which are turned on/off upon the insertion of cassettes of different sizes.

Two-side multicopying unit 128 is arranged at the lower portion of housing 1 to perform two-side copying or multicopying for copying different images on the same sheet surface. Unit 128 has selection gate $60_5$, discharge roller pair $60_4$, and a plurality of roller pairs 128b, 128c and 128d for guiding the sheet from gate $60_5$ to stacking portion 128a. Feedout roller 128e is arranged in portion 128a to feed out the sheets temporarily stacked in portion 128a. Roller 128e can be moved vertically in the direction of the arrow in accordance with the thickness (number) of stacked sheets. The sheets fed by roller 128e are separated by separation roller pair 128f one by one, and each sheet is guided to control gate 128g. Gate 128g is pivoted in the M direction when multicopying is performed, so that the sheet is guided to roller pair 19 through convey roller pair 128h along sheet guide path 128i. However, when two-side copying is performed, gate 128g is set to the position illustrated in FIG. 30, so that the sheet is guided to inverting portion 128k through roller pair 128j. When the sheet is fed to portion 128k, gate 128g is pivoted in the T direction, so that it is guided to pair 19 through pair 128h along path 128i.

Figure 31:
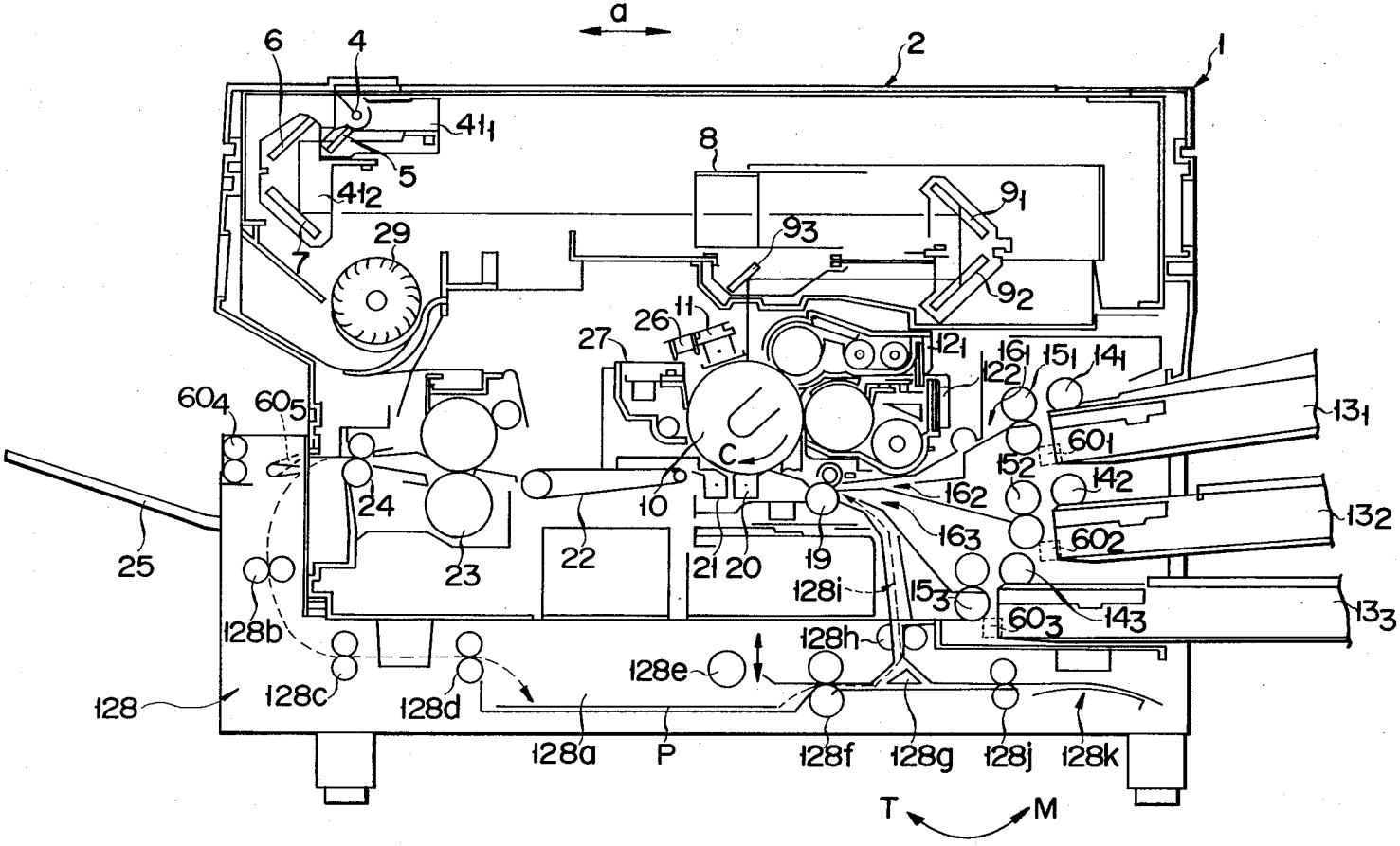

Two-side copying and multicopying modes with the above arrangement will be now described. These modes are selected at the control panel (to be described later). The multicopying mode will be described with reference to FIG. 31. A sheet having an image on one surface thereof is guided into unit 128 through gate $60_5$ set to the broken line position. This sheet is then fed to portion 128a by pairs 128b, 128c and 128d. In this case, roller 128e is up, so the image surface of the sheet faces down. When the operator places another original on table 2 and depresses key $30_1$, roller 128e is moved downward and comes into contact with sheet P. The sheet is thus fed by roller 128e to pair 19 through pair 128f, gate 128g (located in the broken line position), and pair 128h along path 128i. Another original is then copied on the sheet. In this case, the image surface of the sheet is brought into contact with drum 10, so that another image can be formed on the same image surface. The copied sheet is discharged in tray 25 through belt 22, roller pairs 23 and 24, gate $60_5$ (operated in the solid line position), and roller pair $60_4$.

Figure 32:
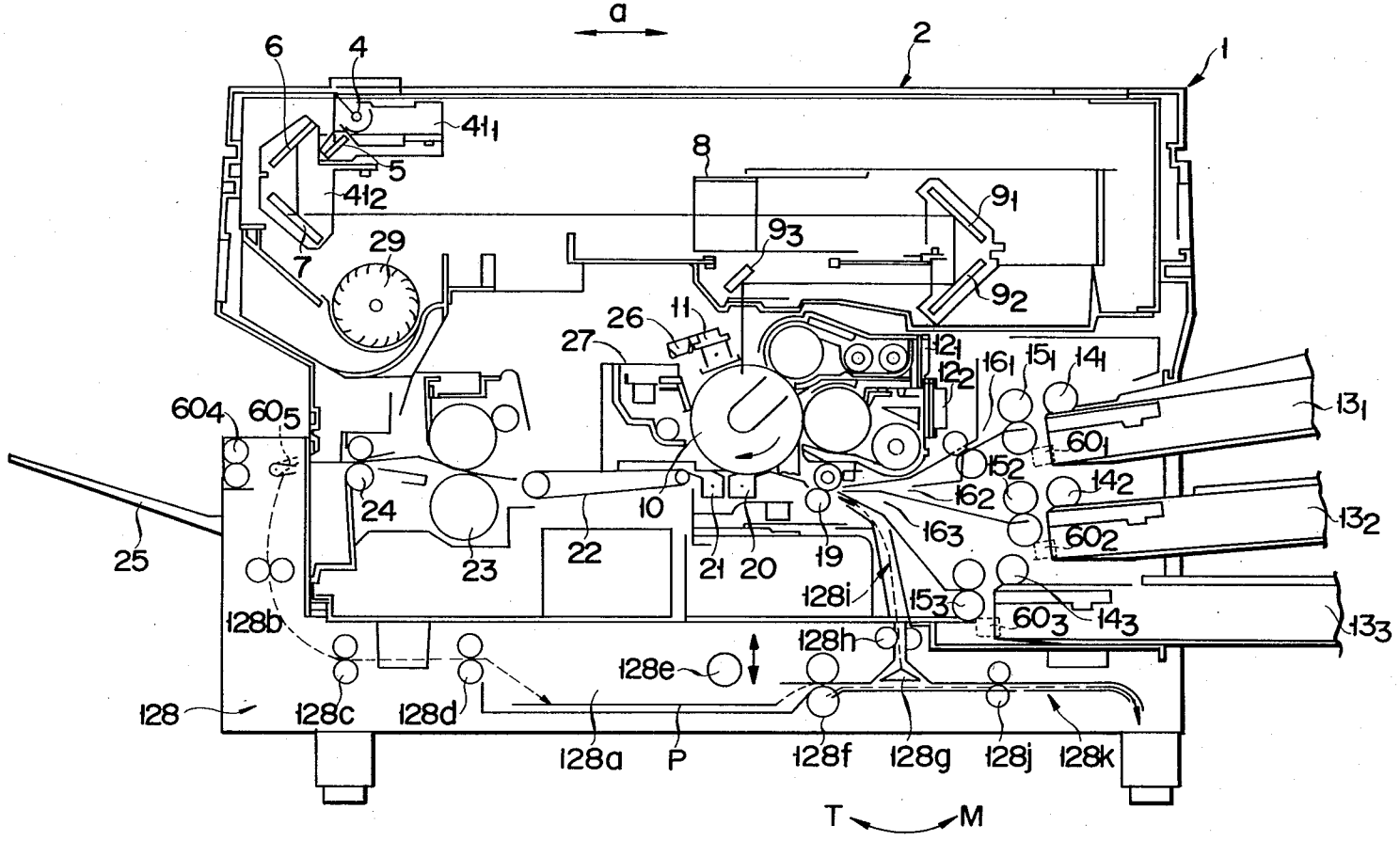

Two-side copying will now be described with reference to FIG. 32. Just as in the multicopying mode, a sheet having an image on one surface is stacked in portion 128a of unit 128. When the operator places another original on table 2 and depresses key $30_1$, sheet P is fed by roller 128e. The sheet is fed to portion 128k through pair 128f, gate 128g (set to the solid line position), and pair 128j. When the trailing end of the sheet passes through gate 128g, gate 128g is set to the broken line position, and roller pair 128j is rotated in the reverse direction. The sheet is guided to pair 19 through gate 128g and pair 128h along path 128i, thereby allowing second copying. In this case, the image surface of the sheet is not brought into contact with drum 10, so that another image is formed on the blank surface of the sheet. The copied sheet is then discharged in tray 25 in the same manner as in multicopying.

Figure 33:
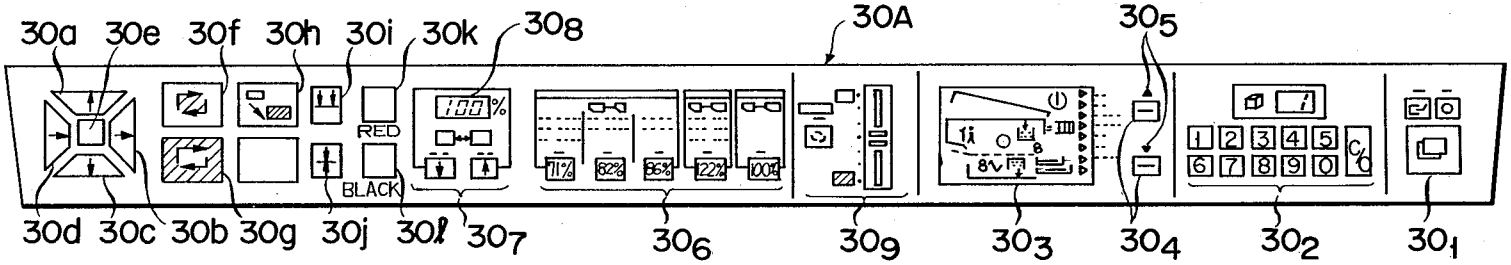

FIG. 33 shows operation panel 30A used in the second embodiment. Referring to FIG. 33, reference numeral 30i denotes a multicopying specifying key; 30j, a two-side copying specifying key; 30k, a red toner specifying key for specifying developing unit $12_1$ containing red toner; and **30*l*, a black toner specifying key for specifying developing unit $12_2$ containing black toner. Reference numeral 30*h* denotes an editing specifying key for enlarging or reducing the image specified by the spot light source and copying the edited image in an area specified by the spot light source in the same manner as in the first embodiment. When the operator does not depress any one of keys 30*h*, 30*i*, 30*j*, 30*k* and 30*l***, or when the copying machine has just been turned on, normal one-side copying is performed.

Figure 34:
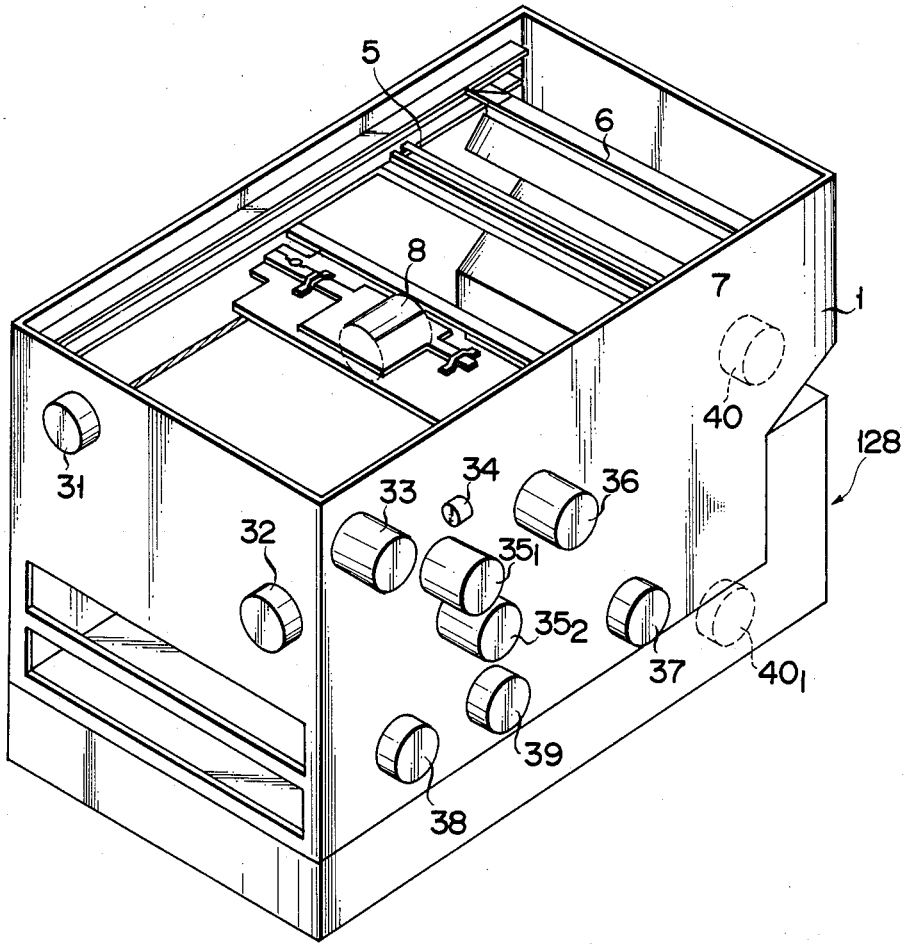

FIG. 34 shows an outer appearance of a drive mechanism for the drive sections used in the second embodiment. Referring to FIG. 34, reference numerals $35_1$ and $35_2$ denote developing motors for driving the developing rollers of units $12_1$ and $12_2$, respectively. In the second embodiment, reference numeral $40_1$ denotes a motor for driving roller pairs **128*b*, 128*c* and 128*d***.

Figure 35:
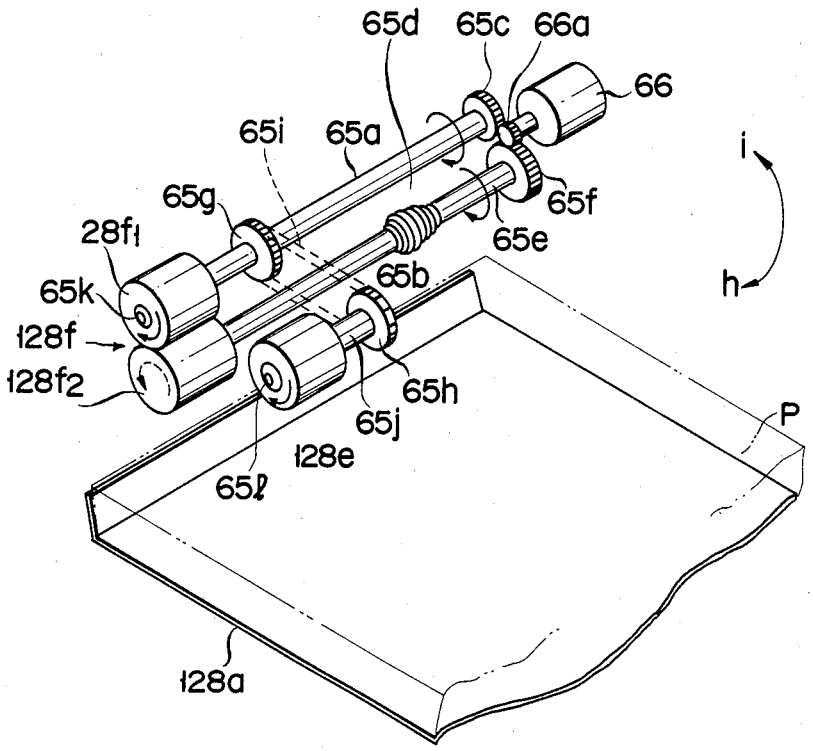

FIG. 35 shows a construction of roller **128*e* and pair 128*f* which together feed out sheets P stacked on portion 128*a*. Rollers 128*f*1 and 128*f*2 constituting pair 128*f* are mounted at first ends of shafts 65*a* and 65*b*, respectively. Gear 65*c* is mounted on the other end of shaft 65*a* and is meshed with gear 66*a* mounted on pulse motor 66. The second end of shaft 65*b* is coupled to the first end of shaft 65*e* through spring clutch 65*d*. The second end of shaft 65*e* has gear 65*f* which is meshed with gear 66*a*. Gear 65*g* is mounted at the intermediate portion of shaft 65*a*, and chain 65*i* is looped between gear 65*g* and gear 65*h* mounted on roller 128*e*. It should be noted that roller 128*e* is driven in the h and i directions by a drive mechanism (not shown). One-way clutches 65*k* and 65*l* are arranged between roller 128*f*1 and shaft 65*a* and between roller 128*e* and shaft 65*j*, respectively. Clutches 65*k* and 65*l* transmit power only when shafts 65*a* and 65*j* are rotated in the direction indicated by the arrows. Furthermore, clutch 65*d* has a frictional force such that shafts 65*b* and 65*e* slip when a force at a contact portion between rollers 128*f*1 and 128*f*2 exceeds force T1. A frictional force between rollers 128*f*1 and 128*f*2 is set to be T2 which is larger than force T1. Therefore, roller 128*f*2 is normally rotated together with rotation of roller 128*f*1 against rotation of motor 66**.

When a frictional force of sheet P is defined as Tf and a frictional force between sheet P and rollers **128*e*, 128*f*1 and 128*f*2 is given as TR, inequality TR>Tf is established. In addition, the relationship between the frictional forces described above and the force at the contact portion between rollers 128*f*1 and 128*f*2** is given as TR>T1>Tf.

Figure 36A:
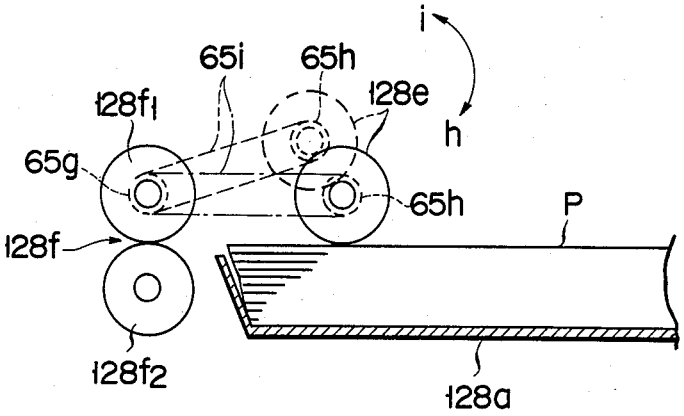
FIGS. 36A to 36D are sectional views showing the principal part of the mechanism of FIG. 35.
Figure 36B:
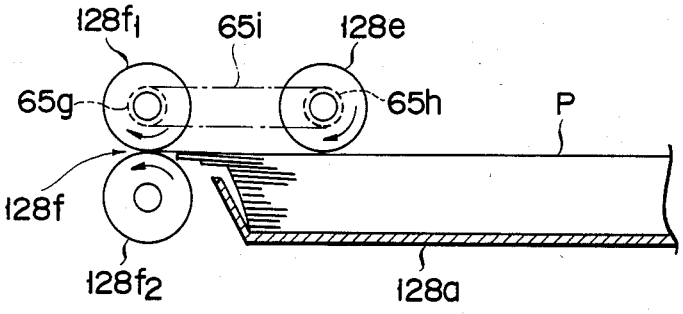
Figure 36C:
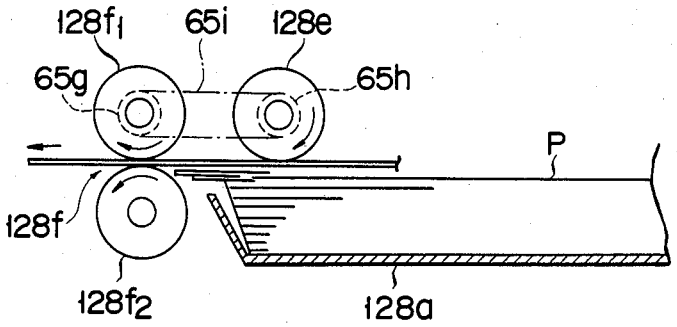
Figure 36D:
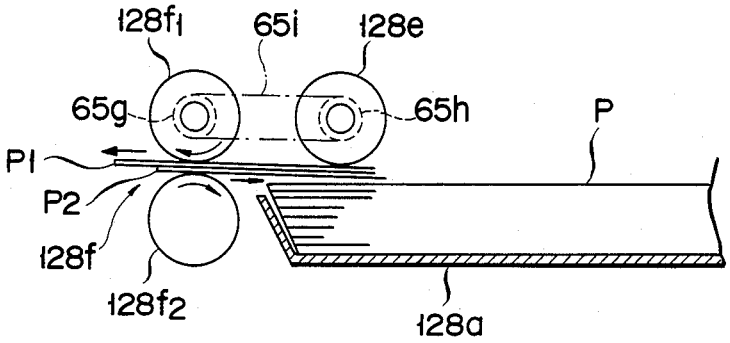

The operation of the above structure will be described hereinafter. When key $30_1$ is depressed after a copied sheet is stacked on portion **128*a*, roller 128*e* is moved downward from the broken line position in the h direction, as shown in FIG. 36A. When roller 128*e* comes into contact with sheet P, as shown in FIG. 36B, motor 66 is started, and rollers 128*f*1, 128*f*2 and 128*e* are rotated in the direction indicated by the arrows. For this reason, sheet P is removed by roller 128*e* from portion 128*a* and is fed by rollers 128*f*1 and 128*f*2, as shown in FIG. 38C. On the other hand, as shown in FIG. 36D, two sheets P1 and P2 are simultaneously fed out from portion 128*a* and are fed between rollers 128*f*1 and 128*f*2. Sheet P1 contacting roller 128*f*1 is fed in the direction indicated by the arrow and sheet P2 contacting roller 128*f*2 is fed back to portion 128*a* since roller 128*f*2 receives power from motor 66 and is rotated in the same direction as that of roller 128*f*1 in accordance with the inequalities described above. Therefore, each sheet is fed out from portion 128*a***.

Figure 37:
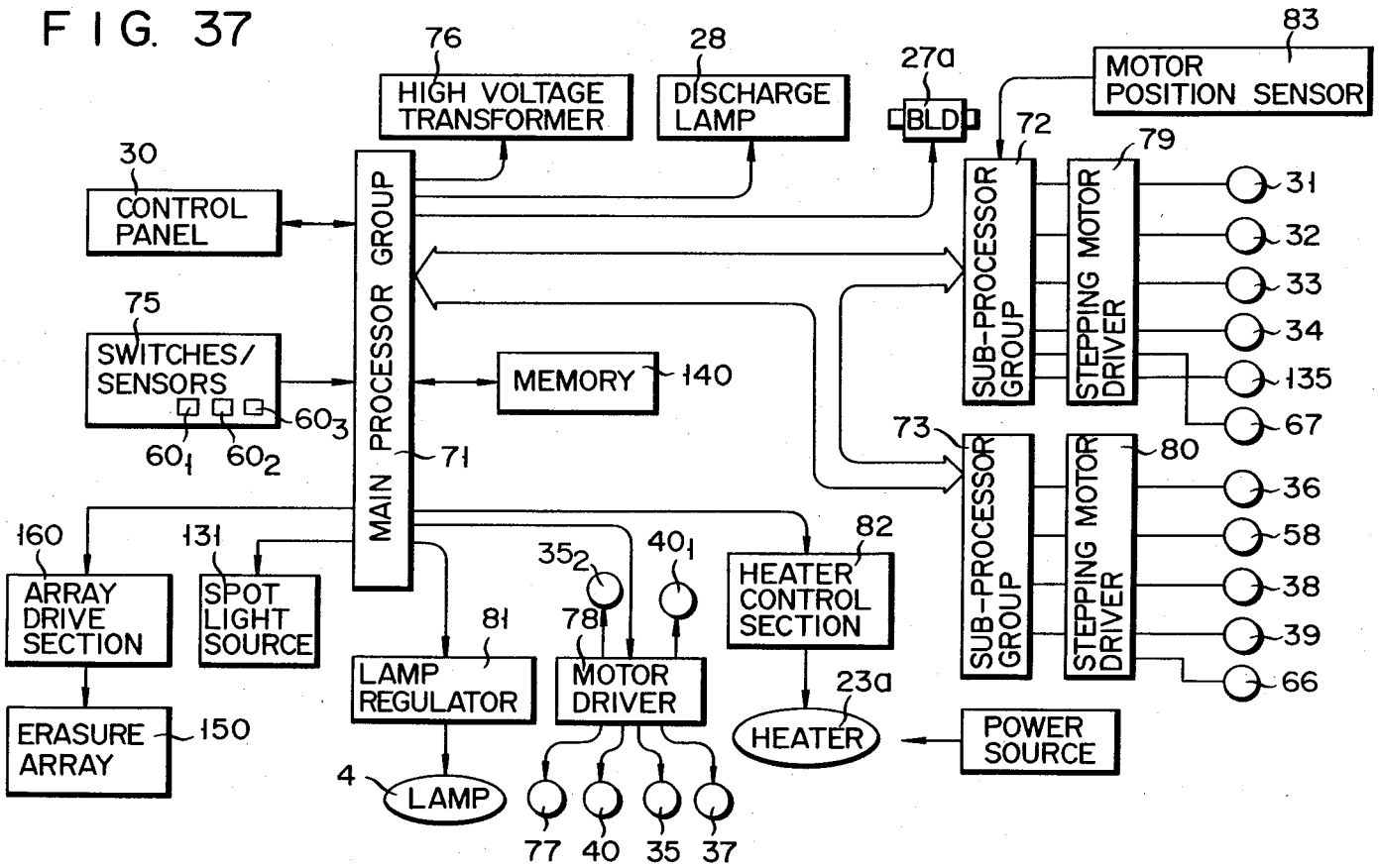

FIG. 37 shows the overall control circuit of the second embodiment. Referring to FIG. 37, switches/sensors 75 include cassette size detection switch $60_3$. Motor driver 78 additionally drives motors $35_1$ and $35_2$. Stepping motor driver 80 additionally drives stepping motor 66. In response to these driving operations, groups 71, 72 and 73 control the overall operation of the copying machine.

It should be noted that the construction, function and operation of the components for specifying the erasure area are the same as those of the first embodiment.

Figure 38:
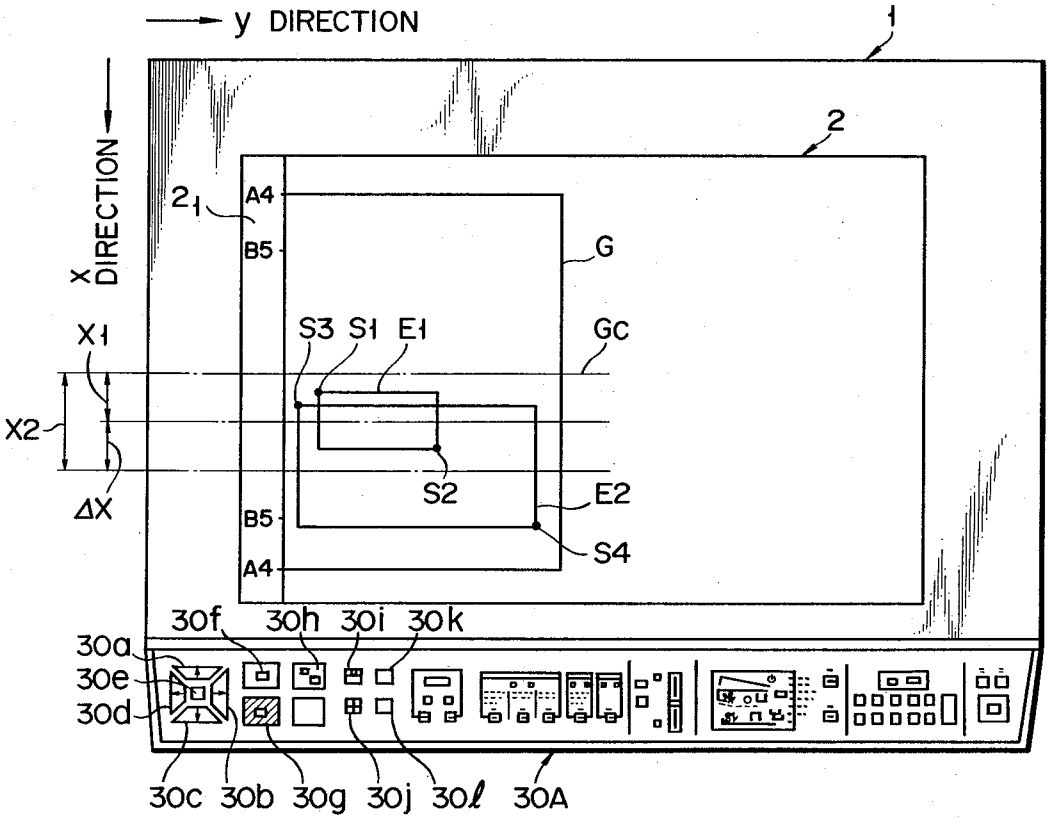

The principal part of the second embodiment will be described hereinafter. The copying machine of this embodiment uses the multicopying function, the image enlargement function, the image reduction function, the image shift function and the image erasure function and shifts an image of a desired portion of the original image to another portion thereof. For example, as shown in FIG. 38, an image in first area E1 of original G placed on table 2 is shifted to second area E2 and copied in a color different from the remaining portion, if desired.

Figure 39A:
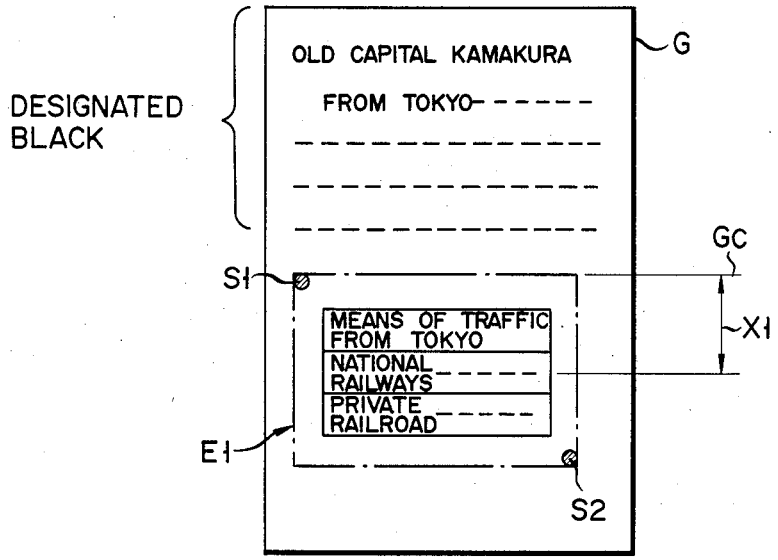
Figure 39B:
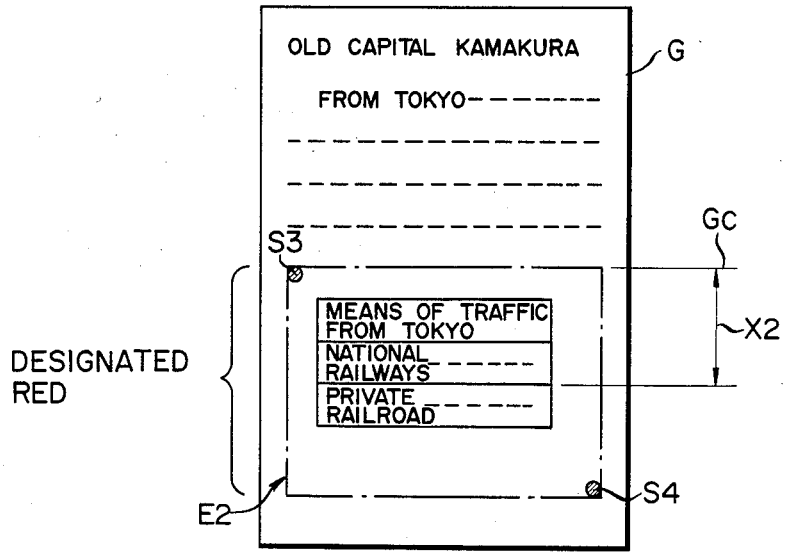

The editing and copying mode will be described with reference to FIGS. 39A to 30E. The operator selectively depresses keys **30*a* to 30*d* and 30*e* on operation panel 30A to specify first area E1 with light spots S1 and S2, as shown in FIG. 39A, and the operator depresses key 30. Similarly, the operator specifies second area E2 with light spots S3 and S4, as shown in FIG. 39B, and depresses key 30*k*. Original G is set with respect to central portion Gc of fixed scale $2_1$. When first and second areas E1 and E2 are specified, distances x1 and x2 (the distances between Gc and the x-direction central portion of area E1 and between Gc and the x-direction central portion of area E2) can be detected. When operator depresses key 30*h* after areas E1 and E2 are specified, group 71 calculates difference $\Delta x$ ($\Delta x = x2 - x1$) between distances x1 and x2. Difference $\Delta x$ corresponds to the x-direction displacement of block 8. Group 71** also calculates x and y lengths of first and second areas E1 and E2 which are represented by coordinates (xE1,yE1) and (xE2,yE2) in accordance with coordinate data of spots S1 and S2 and spots S3 and S4, thereby calculating x and y magnifications Kx and ky as follows:

$$Kx = xE2/xE1$$

$$Ky = yE2/yE1$$

When the x magnification differs from the y magnification, a smaller magnification is selected. 100% of the image specified by first area E1 can therefore be copied in the portion specified by second area E2.

Figure 39C:
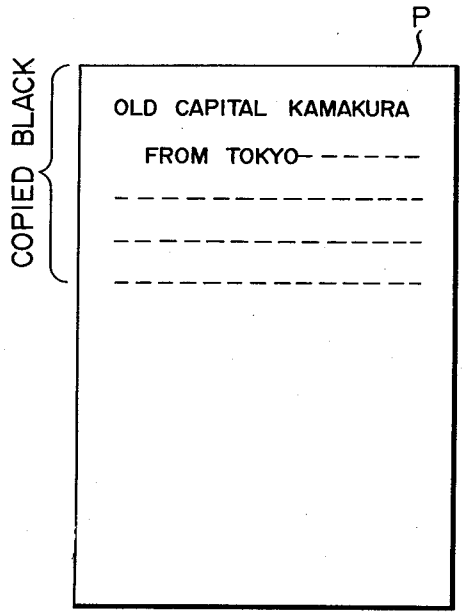
Figure 39D:
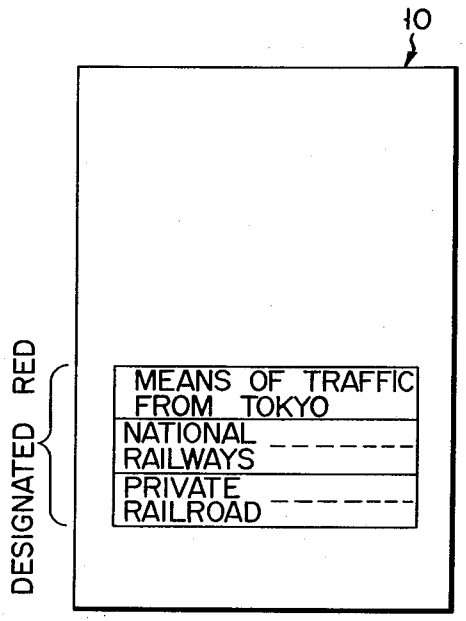
Figure 39E:
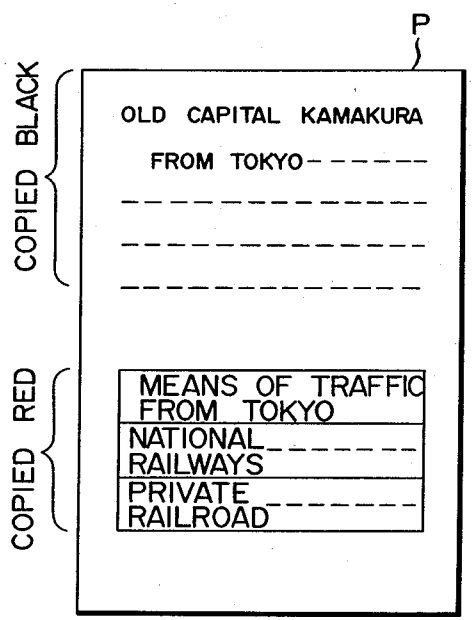

Thereafter, when the operator depresses key $30_1$, carriage $41_1$ is operated to erase the image specified by area E1 in the same manner as when key **30*f* is depressed, and a remaining image portion is copied with black toner. FIG. 39C shows the resultant image copied on sheet P. Copied sheet P is guided to unit 128 and is fed to pair 19 through pairs 128*b*, 128*c* and 128*d*, roller 128*e*, pair 128*f*, gate 128*g* and roller 128*h*. Meanwhile, carriage $41_1$ is returned to the home position and is moved to a predetermined position by pulse motors 67 and 31 operated in response to difference $\Delta x$ and x and y magnifications Kx and Ky. Sheet P synchronized with carriage $41_1$ is fed out from a paper cassette. The image excluding the portion specified by area E2 is erased and a remaining image specified by area E1 is enlarged and formed on drum 10 in area E2, as shown in FIG. 39D, in the same manner as when key 30g is depressed. The image formed on drum 10 is transferred to area E2 on the same image surface from which the image specified by area E1 is erased. In this case, red toner is used. FIG. 39E shows the image formed on sheet P. The copied sheet is discharged in tray 25 through pairs 23, 24** and $60_4$, thereby completing copying operation.

According to the second embodiment, the unnecessary portion of the original can be specified and erased. At the same time, the image specified by the first area can be enlarged or reduced, and shifted to the second area. In addition, the toner color can be changed in each copying cycle. Therefore, the original image can be edited and copied in a variety of applications, thus providing practical advantages.

Furthermore, since spot light source 131 is arranged on carriage $41_1$, the space can be effectively utilized, thereby preventing an increase in apparatus size. The predetermined area of the original can be specified on table 2, and good operability is guaranteed.

In the second embodiment, the portion specified by area E1 is erased and the remaining portion is copied. Thereafter, the image specified by first area E1 is copied in second area E2. However, the image in area E2 can first be erased, and the resulting image is copied. Then, the image specified by area E1 is formed in area E2.

Figure 40A:
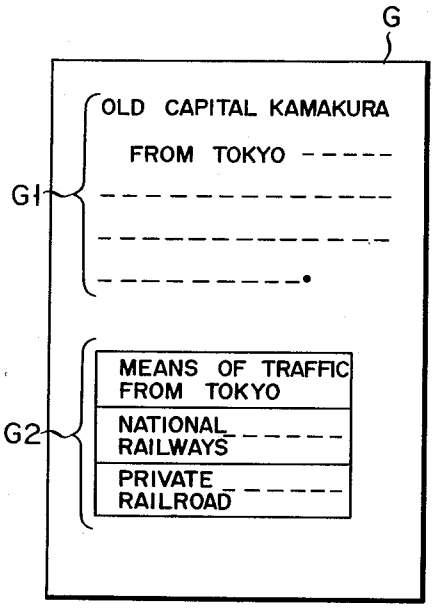
Figure 40B:
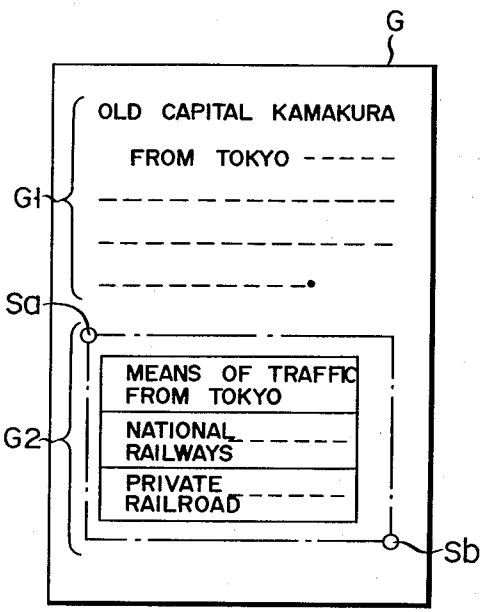
Figure 40C:
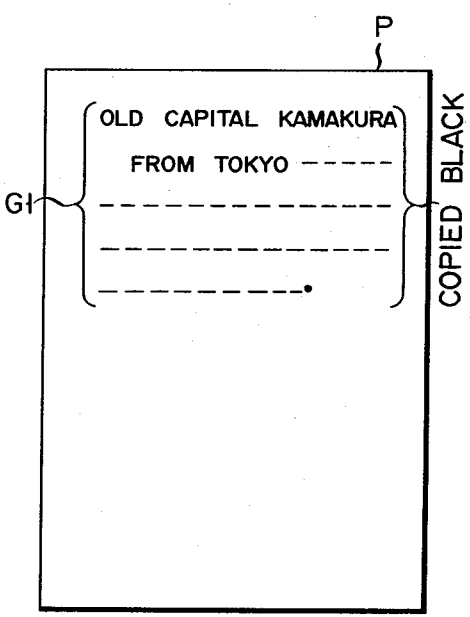

In the above description, the editing and copying operation is exemplified by using key 30h. However, various other editing and copying modes can be utilized. For example, as shown in FIG. 40A, by using monochromatic original G, the G1 and G2 portions can be copied with black and red, respectively. More specifically, the operator places monochromatic original G on table 2 and depresses keys 30i and 30l on operation panel 30. Thereafter, the operator depresses keys 30a to 30d, 30e and 30f to specify coordinates Sa and Sb for erasing the G2 portion to be copied in red. In this state, when the operator depresses key $30_1$, only the G1 portion is copied on sheet P with black toner, as shown in FIG. 40C. This sheet P is temporarily stacked on portion 128a.

Figure 40D:
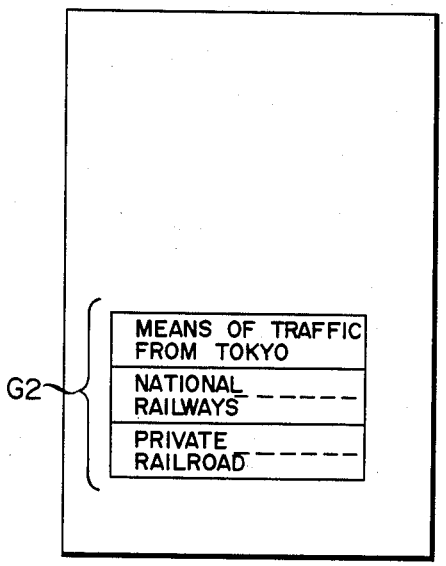
Figure 40E:
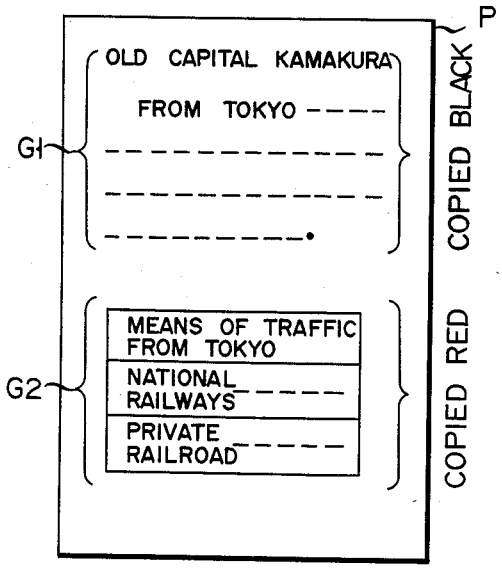

Thereafter, when the operator depresses key 30g, a portion (i.e., the G1 portion) excluding that specified by coordinates Sa and Sb is specified. In this state, when the operator sequentially depresses keys 30k and $30_1$, sheet P having the image of only the G1 portion as shown in FIG. 40C is fed. Subsequently, only the G2 portion is copied in red, as shown in FIG. 40D. Therefore, as shown in FIG. 40E, the G1 portion is copied in black, while the G2 portion is copied in red.

When a plurality of sheets are copied, only the G1 portions are copied with black toner to all sheets. Thereafter, the G2 portions are copied with red toner to all sheets.

The toner colors are not limited to black and red, but can be extended to other colors.

According to the second embodiment as described in detail, there is provided an image forming apparatus for selectively erasing, enlarging, reducing and shifting any portion of the original image and for forming an edited image in different colors.

A third embodiment of the present invention will be described hereinafter. If not specifically described, the constitution of the third embodiment is the same as that of the first embodiment.

Figure 41:
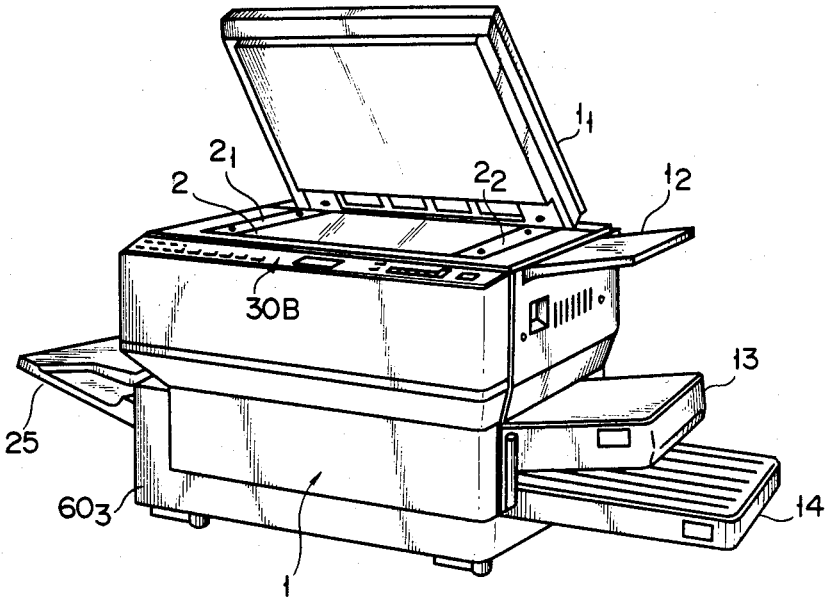
Figure 42:
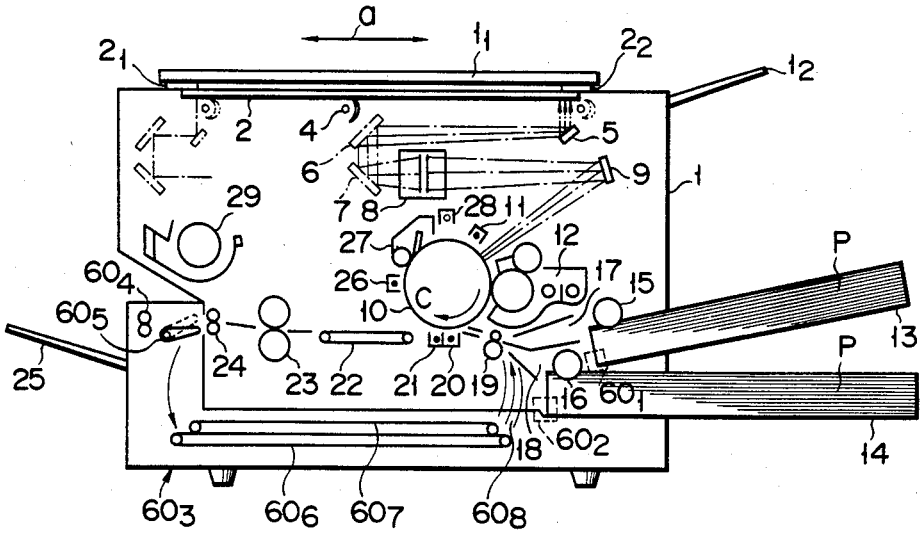

Referring to FIGS. 41 and 42 showing the schematic arrangement of a copying machine of the third embodiment, first and second fixed scales $2_1$ and $2_2$ as references for setting an original are arranged at two ends of table 2.

Figure 43:
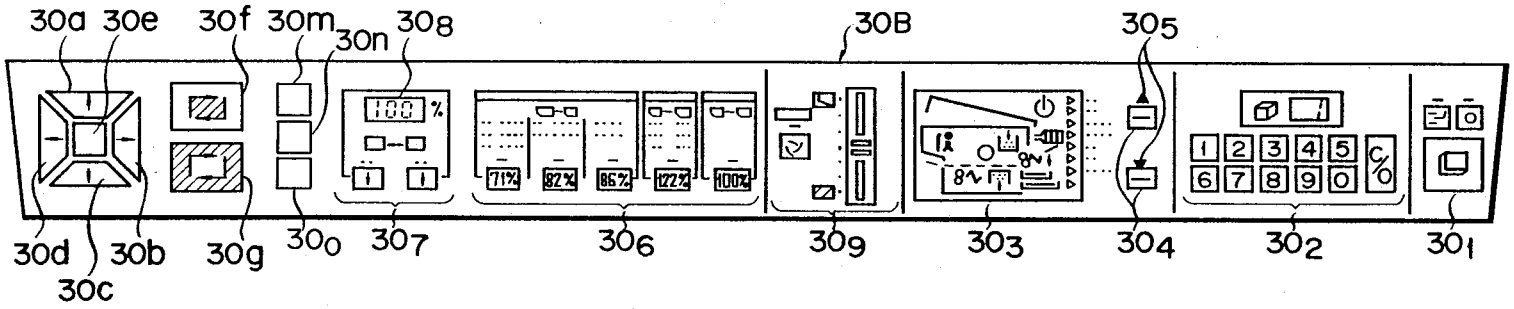

FIG. 43 shows operation panel 30B used in the third embodiment. Referring to FIG. 43, reference numerals 30m and 30n denote original specifying keys for specifying the original placed on the original table; and 30o, editing specifying key for specifying editing of the image.

The drive source for drive sections and the overall control circuit and the mechanism for specifying the erasure area in the third embodiment are the same as those of the first embodiment, except that the control form of the overall control circuit is suitable for the principal portion of the third embodiment to be described later.

Figure 44:
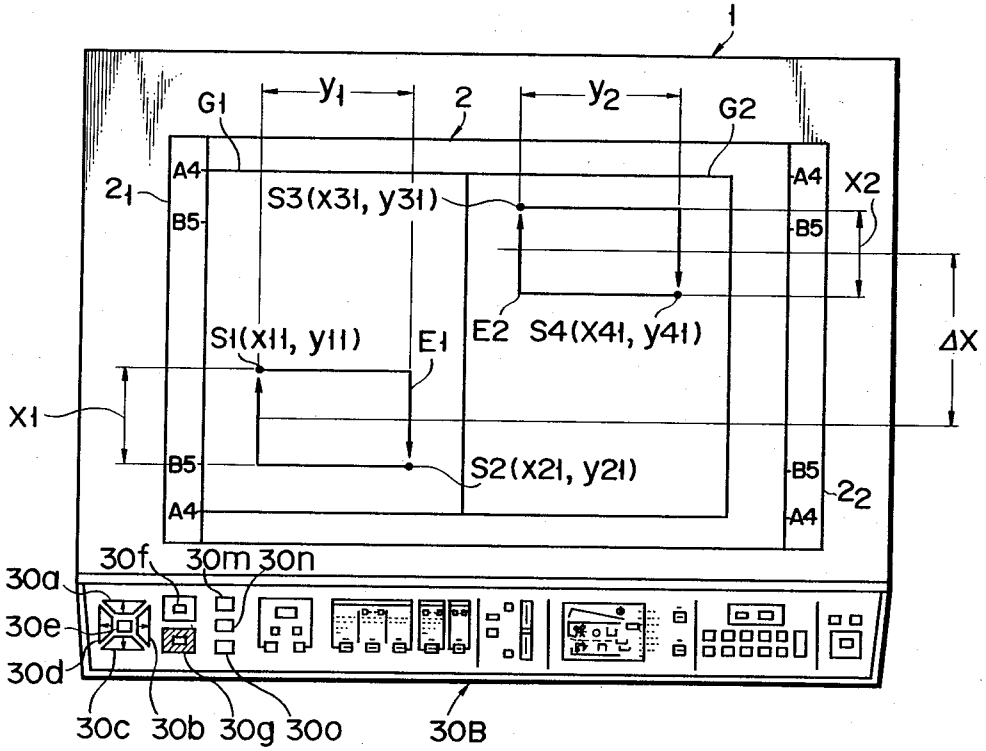

The principal portion of the third embodiment of the present invention will be described hereinafter. The copying machine exemplified by the third embodiment can edit the original image and copy an edited image. More particularly, a desired portion of an image of an original is shifted to a desired portion of another original, and a shifted image can be copied on the desired portion of the latter original. For example, as shown in FIG. 44, an image represented by area E1 and included in first original G1 set at the side of scale $2_1$ on table 2 is erased, and an image represented by area E2 and included in second original G2 set adjacent to original G1 can be enlarged or reduced and copied in the erased portion of original G1.

The editing and copying modes will be described with reference to FIG. 45. The operator depresses key 30m at panel 30B and moves spot light to specify area E1 of original G1 by coordinate data of light spots S1 and S2. Subsequently, the operator depresses key 30n and moves spot light to specify area E2 of original G2 by coordinate data of light spots S3 and S4. In this state, when the operator depresses key 30o, group 71 calculates x-direction difference $\Delta x = |x11 - x31|$ between x-direction lengths of areas E1 and E2 in accordance with coordinate data of light spots S1 to S4. Difference $\Delta x$ corresponds to an x displacement of block 8. Group 71 also calculates x and y lengths of areas E1 and E2 as coordinates (x1,y1) and (x2,y2) in accordance with coordinate data of spots S1 and S2 and spots S3 and S4, thereby calculating x and y magnifications Kx and Ky as follows:

$$Kx = x2/x1$$

$$Ky = y2/y1$$

When the x magnification differs from the y magnification, a smaller magnification is selected. Y difference $\Delta y$ is given as $|y11 - y31|$.

When the operator depresses key $30_1$ in this state, first original G1 is first scanned, and the image portion specified by area E1 is erased, so that the remaining image portion is copied.

Figure 45A:
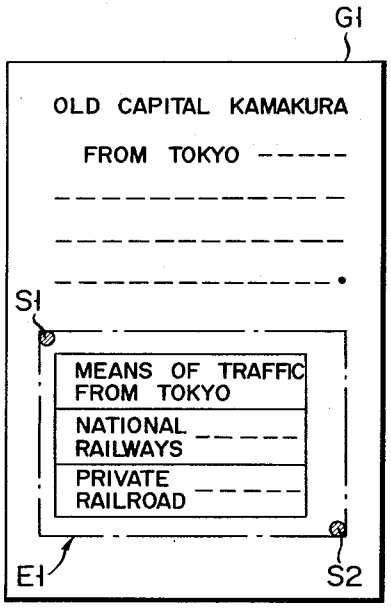
FIGS. 45A to 45E are plan views for explaining editing and copying.
Figure 45B:
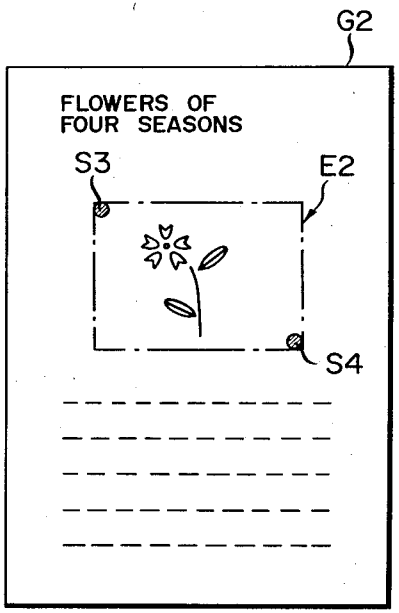
Figure 45C:
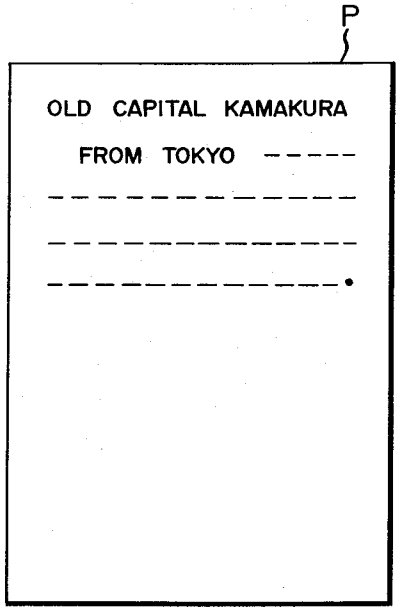
Figure 45D:
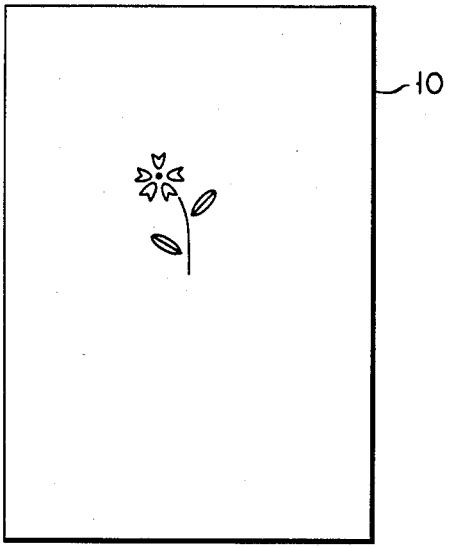
Figure 45E:
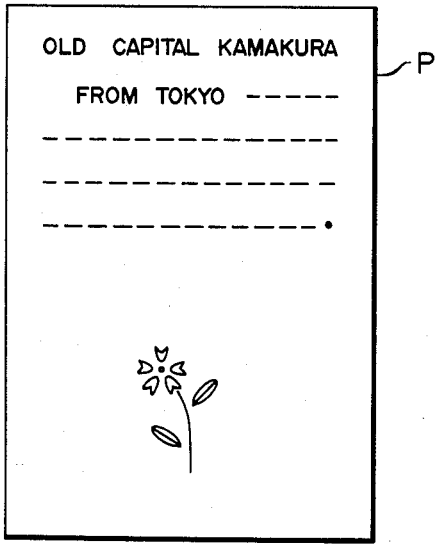

Assume that original G1 is given in FIG. 45A. By the above-mentioned copying operation, an image without a portion corresponding to area E1 is formed on sheet P. Copied sheet P is fed by belts $60_6$ and $60_7$ in unit $60_3$ again to the transfer section. Meanwhile, block 8 is shifted to a predetermined position by pulse motors 67 and 31 driven in response to difference $\Delta x$ and magnification Kx or Ky. When sheet P reaches the transfer section, carriage $41_1$ is shifted from the center position of table 2 toward scale $2_2$, and second original G2 is scanned. Sheet P is fed in response to operation of carriage $41_1$ and is operated in the same manner as when key 30g is depressed, thereby forming an image on drum 10. If original G2 is given as shown in FIG. 45B, an image excluding the portion specified by area E2 is erased. The remaining image is enlarged or reduced in accordance with the magnification corresponding to the size of area E2. The image formed on drum 10 is transferred to the portion of sheet P which is specified by area E1, so that the image is formed on sheet P, as shown in FIG. 45E. Sheet P having the image thereon is discharged to tray 25 through pairs 23, 24 and $60_4$, thereby completing copying.

According to the third embodiment, the unnecessary portion of the original can be specified and erased, and an edited image can be formed. At the same time, a desired portion of original G1 is erased, and a remaining portion is copied. A desired portion of original G2 is enlarged or reduced in accordance with a proper magnification and the enlarged or reduced image can be copied in the erased portion of original G1. Therefore, the original images can be edited and copied in a variety of applications, thus providing practical advantages.

Furthermore, since the erasure position can be specified while two originals are placed on table 2, good operability can be guaranteed.

Figure 46:
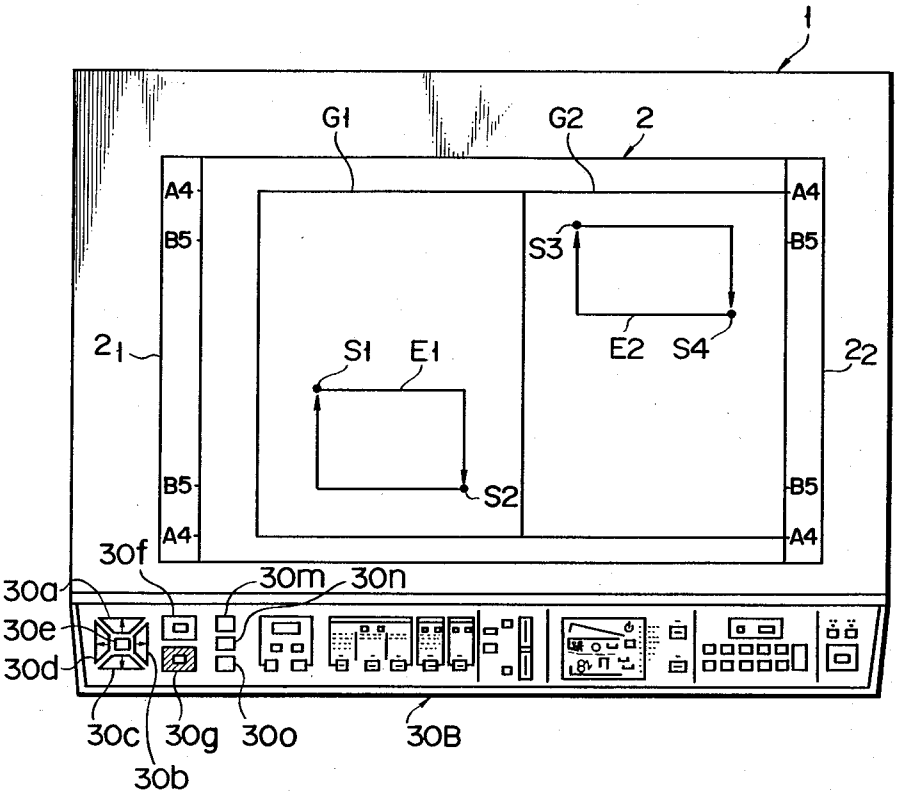
Figure 47:
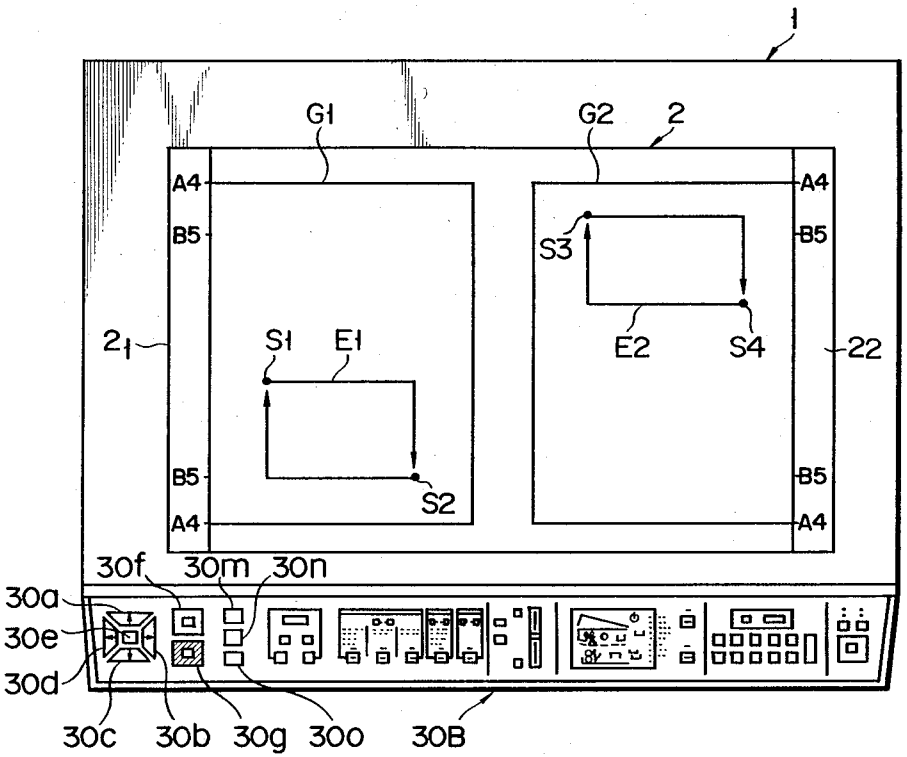

In the third embodiment, original G1 is set at scale $2_1$ and original G2 is set adjacent to original G1. However, when operating timings of carriage $41_1$ and drum 10 are changed, second original G2 can be set at scale $2_2$ and first original G1 can be set adjacent to second original G2, as shown in FIG. 46. Alternatively, as shown in FIG. 47, first and second originals G1 and G2 can be set at first and second scales $2_1$ and $2_2$, respectively.

According to the third embodiment of the present invention as described above, there is provided an image forming apparatus wherein a desired portion of the original image can be selectively erased, enlarged, reduced and/or shifted, thereby editing images of a plurality of originals and forming an edited image.

Figure 22B:
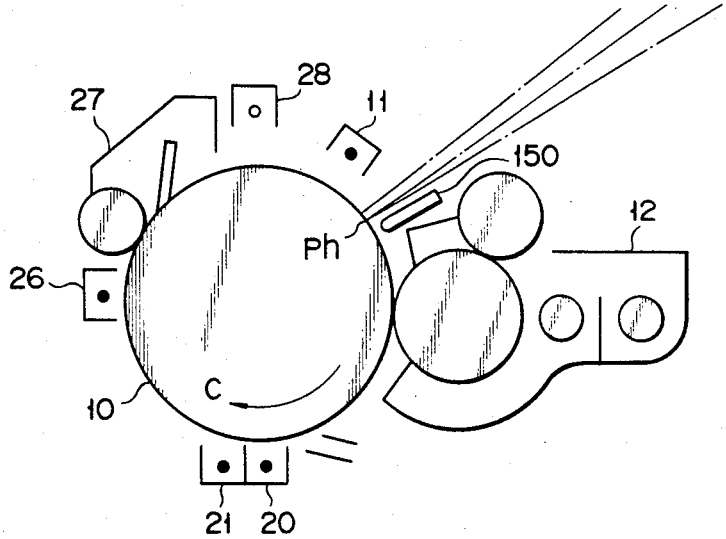
FIG. 22B is a side sectional view of the principal part showing another arrangement of the erasure array.

In each embodiment described above, array 150 need not be arranged between charger 11 and exposure portion Ph, as shown in FIG. 22A. However, as shown in FIG. 22B, array 150 may be arranged between portion Ph and unit 12, and the latent image can be erased as needed.

Other changes and modifications may be made within the spirit and scope of the present invention.

What is claimed is:

1. An image forming apparatus with an editing function, said apparatus comprising:

an original table on which an original is placed, the original being capable of transmitting light therethrough;

light-transmitting means for emitting the light to the original place on said original table while the light is moved therealong;

shift source specifying means for moving the light from said light-transmitting means along a desired first portion of the original placed on said original table and specifying a shift source;

shift destination specifying means for moving the light from said light-transmitting means along a desired second portion of the original placed on said original table and specifying a shift destination;

first controlling means for calculating position information of the desired first portion specified by said shift source specifying means, position information of a portion excluding the desired second portion specified by said shift destination specifying means, and distance information representing a distance between the desired first and second portions in accordance with shift data of light moved by said light-transmitting means, and for storing the calculated information;

original scanning means arranged to be movable along said original table and having a first optical system for optically scanning the original placed on said original table and a second optical system movable to extract an image reflected by said first optical system from the original with a predetermined magnification;

image forming means for focusing the reflected image extracted by said original scanning means on an image forming medium and developing and forming an image corresponding to the reflected image on the image forming medium;

image erasing means for selectively erasing an image to be formed by said image forming means;

image forming medium feedback means for selectively feeding back to said image forming means the image forming medium with the image formed by said image forming means;

second controlling means for reading out the position information of the desired first portion of the original from said first controlling means during formation of a first image, supplying the readout position information to said image erasing means, and at the same time generating a feedback operation command signal to be supplied to said image forming medium feedback means; and third controlling means for reading out the distance information representing the distance between the desired first and second portions of the original and the position information representing the portion excluding the desired second portion of the original from said first controlling means and for supplying the readout distance and position information to said second optical system of said original scanning means and said image erasing means.

2. An apparatus according to claim 1, wherein said light-transmitting means is arranged movable with respect to said original scanning means along a direction perpendicular to a moving direction of said first optical system in said original scanning means and includes a light-emitting element and a lens which emit spot light as the light transmitted through the original.

3. An apparatus according to claim 1, wherein said image erasing means includes a plurality of light-emitting elements aligned in line and opposite to said image forming means.

4. An apparatus according to claim 3, wherein said plurality of light-emitting means are arranged at positions where the light is selectively emitted to said image forming means during focusing process by said image forming means.

5. An apparatus according to claim 3, wherein said plurality of light-emitting elements are arranged at positions where the light is selectively emitted to said image forming means during developing process by said image forming means.

6. An image forming apparatus with an editing function, said apparatus comprising:

an original table on which an original is placed, the original being capable of transmitting light therethrough;

light-transmitting means for emitting the light to the original placed on said original table while the light is moved therealong;

shift source specifying means for moving the light from said light-transmitting means along a desired first portion of the original placed on said original table and specifying a shift source;

shift destination specifying means for moving the light from said light-transmitting means along a desired second portion of the original placed on said original table and specifying a shift destination;

image forming color specifying means for specifying a desired one of a plurality of image forming colors in accordance with operation of said shift source and destination specifying means;

first controlling means for calculating position information of the desired first portion specified by said shift source specifying means, position information of a portion excluding the desired second portion specified by said shift destination specifying means, and distance information representing a distance between the desired first and second portions in accordance with shift data of light moved by said light-transmitting means, and for storing the calculated information;

second controlling means for receiving and storing forming color data of first and second images specified by said image forming color specifying means for every operation of said shift source and destination specifying means;

original scanning means arranged to be movable along said original table and having a first optical system for optically scanning the original placed on said original table and a second optical system movable to extract an image reflected by said first optical system from the original with a predetermined magnification;

image forming means for focusing the reflected image extracted by said original scanning means on an image forming medium and developing and forming an image corresponding to the reflected image on the image forming medium, and for causing a plurality of developing units for the plurality of forming colors to selectively operate to form an image with a single or a plurality of colors on the image forming medium;

image erasing means for selectively erasing an image to be formed by said image forming means;

image forming medium feedback means for selectively feeding back to said image forming means the image forming medium with the image formed by said image forming means;

third controlling means for supplying, during formation of the first image, as a drive signal color data of the first image from said second controlling means to a corresponding one of the developing units, for reading out the position information of the desired first portion from said first controlling means and supplying the readout position information to said image erasing means, and for supplying a feedback operation command signal to said image forming medium feedback means; and fourth controlling means for supplying, during formation of the second image, as a drive signal color data of the second image from said second controlling means to a corresponding one of the developing units, for reading out the distance information representing the distance between the desired first and second portions of the original and the position information representing the portion excluding the desired second portion of the original from said first controlling means and supplying the readout distance and position information to said second optical system in said original scanning means and said image erasing means.

7. An apparatus according to claim 6, wherein said light-transmitting means is arranged movable with respect to said original scanning means along a direction perpendicular to a moving direction of said first optical system in said image scanning means and includes a light-emitting element and a lens which emit spot light as the light transmitted through the original.

8. An apparatus according to claim 6, wherein said image erasing means includes a plurality of light-emitting elements aligned in line and opposite to said image forming means.

9. An apparatus according to claim 6, wherein said plurality of light-emitting means are arranged at positions where the light is selectively emitted to said image forming means during focusing process by said image forming means.

10. An apparatus according to claim 6, wherein said plurality of light-emitting elements are arranged at positions where the light is selectively emitted to said image forming means during developing process by said image forming means.

11. An image forming apparatus with an editing function, said apparatus comprising:

an original table on which first and second originals are placed, the first and second originals capable of transmitting light therethrough;

light-transmitting means for emitting the light to the first and second originals placed on said original table while the light is moved therealong;

shift destination specifying means for moving the light from said light-transmitting means along a desired first portion of the first original placed on said original table and specifying a shift destination;

shift source specifying means for moving the light from said light-transmitting means along a desired second portion of the second original placed on said original table and specifying a shift source;

first controlling means for calculating position information of the desired first portion specified by said shift destination specifying means, position information of a portion excluding the desired second portion specified by said shift source specifying means, and distance information representing a distance between the desired first and second portions in accordance with shift data of light moved by said light-transmitting means, and for storing the calculated information;

original scanning means arranged to be movable along said original table and having a first optical system for optically and selectively scanning the first and second originals placed on said original table and a second optical system movable to extract an image reflected by said first optical system from the first and second originals with a predetermined magnification;

image forming means for focusing the reflected image extracted by said original scanning means on an image forming medium and developing and forming an image corresponding to the reflected image on the image forming medium;

image erasing means for selectively erasing an image to be formed by said image forming means;

image forming medium feedback means for selectively feeding back to said image forming means the image forming medium with the image formed by said image forming means;

second controlling means for reading out the position information of the desired first portion of the first original from said first controlling means during image formation for the first original, supplying the readout position information to said image erasing means, and at the same time generating a feedback operation command signal to be supplied to said image forming medium feedback means; and third controlling means for reading out the distance information representing the distance between the desired first and second portions of the first and second originals and the position information representing the portion excluding the desired second portion of the second original from said first controlling means during image formation for the second original and for supplying the readout distance and position information to said second optical system of said original scanning means and said image erasing means.

12. An apparatus according to claim 11, wherein the first and second originals are aligned at one end of said original table along a moving direction of said first optical system in said original scanning means.

13. An apparatus according to claim 11, wherein the first and second originals are aligned at the other end of said original table along a moving direction of said first optical system in said original scanning means.

14. An apparatus according to claim 11, wherein the first and second originals are placed at one end and the other end, respectively, of said original table.

15. An apparatus according to claim 11, wherein said light-transmitting means is arranged movable with respect to said original scanning means along a direction perpendicular to a moving direction of said first optical system in said image scanning means and includes a light-emitting element and a lens which emit spot light as the light transmitted through the originals.

16. An apparatus according to claim 11, wherein said image erasing means includes a plurality of light-emitting elements aligned in line and opposite to said image forming means.

17. An apparatus according to claim 16, wherein said plurality of light-emitting means are arranged at positions where the light is selectively emitted to said image forming means during focusing process by said image forming means.

18. An apparatus according to claim 16, wherein said plurality of light-emitting elements are arranged at positions where the light is selectively emitted to said image forming means during developing process by said image forming means.

* * * * *